US011211692B2

(12) United States Patent
Huang et al.

(10) Patent No.: US 11,211,692 B2
(45) Date of Patent: Dec. 28, 2021

(54) ANTENNA STRUCTURE AND ELECTRONIC DEVICE

(71) Applicant: ETHETA COMMUNICATION TECHNOLOGY(SHENZHEN)CO., LTD, Shenzhen (CN)

(72) Inventors: Huan-Chu Huang, Shenzhen (CN); Zhixing Qi, Shenzhen (CN); Dasong Gao, Shenzhen (CN); Hong Lin, Shenzhen (CN); Yanchao Zhou, Shenzhen (CN)

( * ) Notice: Subject to any disclaimer, the term of this patent is extended or adjusted under 35 U.S.C. 154(b) by 0 days.

(21) Appl. No.: 17/117,032

(22) Filed: Dec. 9, 2020

(65) Prior Publication Data

US 2021/0104811 A1 Apr. 8, 2021

(30) Foreign Application Priority Data

Nov. 23, 2020 (CN) ..... 202011321633.4

(51) Int. Cl.
*H01Q 1/24* (2006.01)
*H01Q 1/38* (2006.01)
*H01Q 9/04* (2006.01)

(52) U.S. Cl.
CPC ..... *H01Q 1/243* (2013.01); *H01Q 1/38* (2013.01); *H01Q 9/04* (2013.01)

(58) Field of Classification Search
CPC ..... H01Q 1/243; H01Q 1/38; H01Q 9/04
See application file for complete search history.

(56) References Cited

U.S. PATENT DOCUMENTS

2007/0069960 A1* 3/2007 Moon ..... H01Q 21/065 343/700 MS
2007/0216583 A1 9/2007 Hou
2013/0088400 A1* 4/2013 Chen ..... H01Q 13/10 343/770
2013/0099992 A1* 4/2013 Wu ..... H01Q 21/30 343/841
2013/0293425 A1* 11/2013 Zhu ..... H01Q 13/10 343/702
2014/0043202 A1* 2/2014 Wong ..... H01Q 1/48 343/848
2014/0152524 A1* 6/2014 Tu ..... H01Q 1/521 343/843
2015/0214612 A1* 7/2015 Chen ..... H01Q 1/525 343/841
2016/0218421 A1 7/2016 Lin
(Continued)

*Primary Examiner* — Graham P Smith
*Assistant Examiner* — Jae K Kim

(57) ABSTRACT

The present disclosure discloses an antenna structure and an electronic device having the same. The antenna structure comprises a first antenna, a second antenna and a three-dimensional decoupling structure located on at least two planes, wherein the three-dimensional decoupling structure comprises a conductor, and at least part of the three-dimensional decoupling structure is located in a space between the first antenna and the second antenna. Compared with the prior art, the antenna structure and the electronic device having the same disclosed by the present disclosure can effectively achieve the antenna decoupling effect through the three-dimensional decoupling structure, so that the degradation degree of antenna performance due to coupling can be reduced, and meanwhile, the three-dimensional space of the system can be better utilized.

18 Claims, 11 Drawing Sheets

(56) References Cited

U.S. PATENT DOCUMENTS

| | | | | |
|---|---|---|---|---|
| 2017/0373393 | A1* | 12/2017 | Tatomirescu | H01Q 21/28 |
| 2019/0252770 | A1* | 8/2019 | Thakur | H01Q 1/521 |
| 2020/0021015 | A1 | 1/2020 | Yun et al. | |
| 2020/0195289 | A1* | 6/2020 | Chang | H01Q 1/24 |

* cited by examiner

ANTENNA STRUCTURE AND ELECTRONIC DEVICE

TECHNICAL FIELD

The present disclosure relates to the technical field of antennas, and in particular to an antenna structure and an electronic device having the same.

BACKGROUND

In the 5G (fifth generation mobile communication) era, in order to meet the communication requirements of MIMO (Multi-input and Multi-output) with more channels and cover more new frequency bands, the number of antennas in mobile phones is obviously increased compared with the previous generation of mobile communication, but the size of mobile phones has not increased proportionally, so that the distance between antennas is significantly shortened. Furthermore, the coupling phenomenon between antennas with the same frequency or different frequencies becomes more serious (especially between antennas with the same frequency or near frequency), and the performance of the antennas obviously degrades which hence deteriorates the wireless communication experience of users.

Based on the above, different decoupling methods have been put forward, such as a layout method (e.g., pulling away the mutually coupled antennas or providing the mutually coupled antennas orthogonally), an external structural method (comprising isolation or filtering structures in antenna design or between antennas), a defect ground method (i.e., performing excavation design on the reference ground of mutually coupled antennas), an artificial material method (i.e., adding artificial electromagnetic materials between mutually coupled antennas), a circuit method (i.e., adding a decoupling circuit to the antenna port or the antenna main body of the mutually coupled antenna), a characteristic-mode method (i.e., based on the characteristic modes), and a neutralization line method (i.e., directly adding additional connection lines to the mutually coupled antenna), etc. However, the layout method cannot be used well in compact systems with limited space, so the effect is not obvious. The external structural method will increase the distance between antennas, which will affect the compactness of the system and even the size of the system. The defect ground method will destroy the main environment of the system, so it is often not feasible in practical compact systems. The artificial material method is more complicated in design, and often need extra space or carrier. The circuit method is complicated in design, especially for multi-frequency or broadband decoupling. The characteristic-mode method generally has poor decoupling effect of multi-frequency or broadband decoupling. The traditional neutralization line method often is the planar wirings to connect the antenna main body/bodies, and the area below the neutralization line often needs clearance, so it occupies more board area and has higher environment requirements for the board level and even the system.

SUMMARY

In view of this, it is necessary to provide an antenna structure and an electronic device to solve the above problems.

In order to achieve the above object, in a first aspect, an embodiment of the present disclosure discloses an antenna structure, comprising a first antenna;

a second antenna; and a three-dimensional decoupling structure located on at least two planes, wherein the three-dimensional decoupling structure comprises a conductor, and at least part of the three-dimensional decoupling structure is located in a space between the first antenna and the second antenna.

Compared with the prior art, the antenna decoupling effect can be effectively achieved through the three-dimensional decoupling structure, so that the degradation degree of antenna performance due to coupling can be reduced, and meanwhile, the three-dimensional space of the system can be better utilized, that is, the occupied horizontal area in the system can be reduced, so that the utilization rate of limited space can be improved, and, a projected clearance area (i.e., area without conductors) does not need to be provided on the board, so that the integrity of the system motherboard can be better maintained and the decoupling performance can be prevented from being affected by the metal environment or component(s) under the board; therefore, in summary, it can obviously enhance the comprehensive competitiveness of products.

Furthermore, according to an embodiment of the present disclosure, the three-dimensional decoupling structure is independent of both the first antenna and the second antenna in electrical connection. Independent design of electrical connection can have more flexible design freedom, so as to reduce the impact on the original antenna target performance, and achieve the effective decoupling effect, so as to reduce the degradation degree of antenna performance due to coupling, thus ensuring or improving the wireless communication experience of users.

Furthermore, according to an embodiment of the present disclosure, the three-dimensional decoupling structure comprises at least one conductive wire, the conductive wire is located on at least two planes, at least part of the conductive wire is located in a space between the first antenna and the second antenna and is independent of both the first antenna and the second antenna in electrical connection. Through the three-dimensional decoupling structure formed by the conductive wire(s), it is beneficial to reducing the production cost and improving the production efficiency of the three-dimensional decoupling structure, and also beneficial to reducing the volume of the three-dimensional decoupling structure, thereby reducing the occupied space. In addition, the three-dimensional decoupling structure is independent of both the first antenna and the second antenna in electrical connection, so that the decoupling effect of the antenna can be effectively achieved, and the degradation degree of antenna performance due to coupling can be reduced. In addition, when one conductive wire is adopted, the three-dimensional decoupling structure can have a simple and stable structure, and a relatively stable single-frequency decoupling effect can be achieved.

Furthermore, according to an embodiment of the present disclosure, there are at least two conductive wires, and all the conductive wires are provided in parallel at intervals. By arranging at least two conductive wires, the decoupling effect can be improved, and the effect of multi-frequency and broadband decoupling can be achieved, thereby ensuring or improving the communication experience of users.

Furthermore, according to an embodiment of the present disclosure, the antenna structure further comprises a circuit board, wherein the first antenna and the second antenna are both in electrical connection or electrical coupling with the circuit board. The first antenna and the second antenna are in direct electrical connection or direct electrical coupling with the circuit board, so that the compactness of the overall structure can be improved and the miniaturization of the overall structure can be facilitated.

Furthermore, according to an embodiment of the present disclosure, the first antenna and the second antenna both comprise an antenna main body, a grounding part connected to the antenna main body, an antenna feed source part connected to the antenna main body and a matching network part connected to the antenna main body or an adjustable component part (such as an adjustable capacitor, an adjustable inductor, or a switching component, etc., which helps the impedance between the feed source part and the antenna main body to be more matched or adjusts/switches the antenna operating frequency). The circuit board is provided with a grounding end, a feed source end and a matching network end or an adjustable component end. At least parts of the grounding part, the antenna feed source part and the matching network part or the adjustable component part are provided on the circuit board and are connected with the grounding end, the feed source end and the matching network end or the adjustable component end correspondingly. Through the above structured corresponding arrangement, the performance of the first antenna and the second antenna can be guaranteed.

Furthermore, according to an embodiment of the present disclosure, there are at least two conductive wires, the conductive wire comprises a first end and a second end opposite to the first end, the first ends of all the conductive wires are electrically connected through a first electrical connection part, and the first electrical connection part is in electrical connection, electrical coupling or floating connection with the circuit board. At least two conductive wires are provided to guarantee the decoupling effect, and the effect of multi-frequency and broadband decoupling can be achieved, thereby ensuring or improving the communication experience of users; the first electrical connection part can be in electrical connection, electrical coupling or floating connection with the circuit board, which is beneficial to improving the production efficiency, reducing the production cost and reducing the volume of the antenna structure.

Furthermore, according to an embodiment of the present disclosure, the second ends of all the conductive wires are electrically connected through a second electrical connection part, and the second electrical connection part is in electrical connection, electrical coupling or floating connection with the circuit board; or the second ends of all the conductive wires are in electrical connection, electrical coupling or floating connection with the circuit board. The second electrical connection part can be effectively electrically connected with the conductive wire and the circuit board, which is also beneficial to improving production efficiency, reducing production cost and reducing the volume of the antenna structure.

Furthermore, according to an embodiment of the present disclosure, there are at least two conductive wires, and the at least two conductive wires are electrically connected through a third electrical connection part. At least two conductive wires are provided, so that the decoupling effect can be improved, and the effect of multi-frequency and broadband decoupling can be achieved, thereby ensuring or improving the communication experience of users. A plurality of conductive wires are provided and are electrically connected through the third electrical connection part, so that the three-dimensional decoupling structure and the antenna structure can have higher design freedom, achieve more quantifiable, more accurate and faster design, and have more opportunities to improve manufacturability and reduce the size of the decoupling structure and the antenna structure.

Furthermore, according to an embodiment of the present disclosure, there are at least three conductive wires, and any two adjacent conductive wires are electrically connected through one of the third electrical connection parts. Any two adjacent conductive wires are electrically connected through the third electrical connection part, so that the three-dimensional decoupling structure and the antenna structure have higher design freedom, achieve more quantifiable, more accurate and faster design, and have more opportunities to improve manufacturability and reduce the size of the decoupling structure and the antenna structure.

Furthermore, according to an embodiment of the present disclosure, two adjacent third electrical connection parts are provided facing each other; or two adjacent third electrical connection parts are provided in a staggered manner. The position of the third electrical connection part is provided, so that the three-dimensional decoupling structure and the antenna structure have higher design freedom, achieve more quantifiable, more accurate and faster design, and have more opportunities to improve manufacturability and reduce the size of the decoupling structure and the antenna structure.

Furthermore, according to an embodiment of the present disclosure, the conductive wire comprises a first conductive wire part and a second conductive wire part, and the first conductive wire part and the second conductive wire part are in electrical connection through a third electrical connection part. The first conductive wire part and the second conductive wire part are in electrical connection through a third electrical connection part, so that the three-dimensional decoupling structure and the antenna structure have higher design freedom, achieve more quantifiable, more accurate and faster design, and have more opportunities to improve manufacturability and reduce the size of the decoupling structure and the antenna structure.

Furthermore, according to an embodiment of the present disclosure, the antenna structure further comprises a planar decoupling structure, and the planar decoupling structure and the three-dimensional decoupling structure are in electrical connection through a third electrical connection part. The planar decoupling structure is added and is electrically connected with the three-dimensional decoupling structure, so that the decoupling structure and the antenna structure have higher design freedom, achieve more quantifiable, more accurate and faster design, effectively improve the decoupling performance of the antenna, and increase the performance control of the decoupling structure and the antenna structure, thereby ensuring or improving the communication experience of users.

Furthermore, according to an embodiment of the present disclosure, the third electrical connection part comprises one, two or more other conductive wire(s), active electronic component(s) or passive electronic component(s). The third electrical connection part is provided, so that the three-dimensional decoupling structure and the antenna structure have higher design freedom, achieve more quantifiable, more accurate and faster design, and have more opportunities to improve manufacturability and reduce the size of the decoupling structure and the antenna structure.

Furthermore, according to an embodiment of the present disclosure, there are at least three conductive wires, the conductive wire comprises a first end and a second end opposite to the first end, the first ends of part of the at least three conductive wires are electrically connected through a first electrical connection part, the first electrical connection part is also in electrical connection, electrical coupling or floating connection with the circuit board; the second ends of another part of the at least three conductive wires are electrically connected through a second electrical connection part, and the second electrical connection part is also in electrical connection, electrical coupling or floating connection with the circuit board. A plurality of wires are provided, so that not only the decoupling effect can be improved, but also the effect of multi-frequency and broadband decoupling can be achieved. The first electrical connection part and the second electrical connection part are provided, which is also beneficial to improving the production efficiency, reducing the production cost and reducing the volume of the antenna structure. In addition, the above electrical connection method can also increase the design freedom of the three-dimensional decoupling structure, achieve more quantifiable, more accurate and faster design, and have more opportunities to improve manufacturability and reduce the size of the decoupling structure.

Furthermore, according to an embodiment of the present disclosure, each of the two opposite ends of the conductive wire is in electrical connection, electrical coupling or floating connection with the circuit board. Each of the two opposite ends of the conductive wire is in electrical connection, electrical coupling or floating connection with the circuit board, so as to increase the design freedom of the three-dimensional decoupling structure, achieve more quantifiable, more accurate and faster design, and have more opportunities to improve manufacturability and reduce the size of the decoupling structure.

Furthermore, according to an embodiment of the present disclosure, the conductive wire comprises a first end, a second end opposite to the first end and a middle part located between the first end and the second end, the middle part is connected to another conductive wire, and the another conductive wire is in electrical connection, electrical coupling or floating connection with the circuit board. The middle part is connected to another wire, and the another wire is in electrical connection, electrical coupling or floating connection with the circuit board, so that the three-dimensional decoupling structure has higher design freedom, achieves the effect of multi-frequency and broadband decoupling, and contributes to the compactness of the overall structure and the miniaturization of the structure size.

Furthermore, according to an embodiment of the present disclosure, the antenna structure further comprises a three-dimensional decoupling structure support provided on the circuit board, the conductive wire is provided on the three-dimensional decoupling structure support; the antenna structure further comprises a first structure provided on the circuit board and located on one side of the three-dimensional decoupling structure support, and at least parts of the first antenna and the second antenna are provided on the first structure. The three-dimensional decoupling structure support can also realize diversified three-dimensional design of the conductive wire, so that the three-dimensional decoupling structure and the antenna structure have higher design freedom, achieve more quantifiable, more accurate and faster design, and have more opportunities to improve manufacturability and reduce the size of the decoupling structure and the antenna structure.

Furthermore, according to an embodiment of the present disclosure, there are at least two conductive wires, the three-dimensional decoupling structure support comprises a first side surface, a top surface connected to the first side surface, a second side surface connected to the top surface and opposite to the first side surface, and a third side surface connected to the first side surface, the top surface and the second side surface, at least part of at least one conductive wire is provided on the top surface, and at least part of at least one conductive wire is provided on the third side surface. At least two conductive wires are provided, so that the decoupling effect can be improved, and the effect of multi-frequency and broadband decoupling can be achieved. The conductive wire is provided on the end surface of the three-dimensional decoupling support, so that the space of the three-dimensional decoupling structure support can be effectively utilized, and the volume of the three-dimensional decoupling, structure support can be reduced, so that the volume of the antenna structure is reduced and the space utilization rate is improved.

In a second aspect, an embodiment of the present disclosure discloses an electronic device, which comprises the antenna structure described in any of the above embodiments.

It can be understood that the electronic device adopts the antenna structure, so that it can be understood that the electronic device naturally has the effect characteristics of the antenna structure, which is not described in detail here.

Compared with the prior art, the present disclosure has the following beneficial effects.

The antenna structure and the electronic device having the same disclosed by the present disclosure can effectively achieve the antenna decoupling effect through the three-dimensional decoupling structure, so that the degradation degree of antenna performance due to coupling can be reduced, and meanwhile, the three-dimensional space of the system can be better utilized, that is, the occupied horizontal area in the system can be reduced, so that the utilization rate of limited space can be improved, and the metal clearance or metal avoidance on the circuit board is not needed, so that the integrity of the circuit board can be maintained; therefore, in summary, it can obviously enhance the comprehensive competitiveness of products.

In the embodiment of the present disclosure, a plurality of (including two or more) antennas are decoupled by utilizing the conductive three-dimensional decoupling structure of adjacent antennas, so that the three-dimensional space of the system can be better utilized, that is, the occupied horizontal area in the system can be reduced, so that the utilization rate of limited space can be improved, and a projected clearance area (i.e., area without conductors) does not need to be provided on the board, so that the integrity of the system motherboard can be better maintained and the decoupling performance can be prevented from being affected by the metal environment or component(s) under the board. In addition, the present disclosure can also provide a conductive three-dimensional decoupling structure consisted of a plurality of conductive wires, and the decoupling frequency corresponding to the three-dimensional decoupling structure can fall within the frequency band of the antenna design target by designing appropriate geometric dimensions (such as length, width, radian, etc.), number, electrical connection situation, material (non-conductor) of the three-dimensional decoupling structure support or carrier, the support or carrier structure and so on, so as to perform broadband or multi-frequency decoupling to reduce the degradation degree of antenna performance and ensure or enhance the wireless experience of users. The conductive three-dimensional decoupling structure consisted of a plurality of conductive wires can be electrically connected by wiring or by electronic components, so as to achieve higher design freedom and more performance control, and further reduce the occupied space of the decoupling structure. The width of the single conductive decoupling structure is preferably wider than 1/10000 of the wavelength corresponding to the lowest target decoupling frequency, and the spacing between the decoupling structures consisted of a plurality of conductive wires is preferably wider than 1/10000 of the wavelength corresponding to the lowest target decoupling frequency.

The types of the decoupled antennas (i.e., the first antenna and the second antenna) are not limited, which can be IFA (an inverted F antenna), PIFA (a planar inverted F antenna), an monopole antenna, a dipole antenna, a patch antenna, a stacked patch antenna, a Yagi-Uda antenna, a slot antenna, a magnetic-electric dipole antenna, a horn antenna, a loop antenna, a grid antenna, an open-cavity antenna and the like. The realization process of the conductive decoupling structure and the antenna can be conductor wiring of LTCC (low-temperature co-fired ceramic) or HTCC (high-temperature co-fired ceramic), LDS (laser direct structure), PDS (printed direct circuits), FPC (flexible printed circuits), or stamping. Similarly, the shape, position and size of the three-dimensional decoupling structure support are not limited.

BRIEF DESCRIPTION OF THE DRAWINGS

In order to explain the technical scheme in the embodiments of the present disclosure more clearly, the drawings used in the embodiments will be briefly introduced hereinafter. Obviously, the drawings in the following description are only some embodiments of the present disclosure, and for those skilled in the art, other drawings can be obtained according to these drawings without paying creative labor.

DESCRIPTION OF THE EMBODIMENTS

Figure 1:
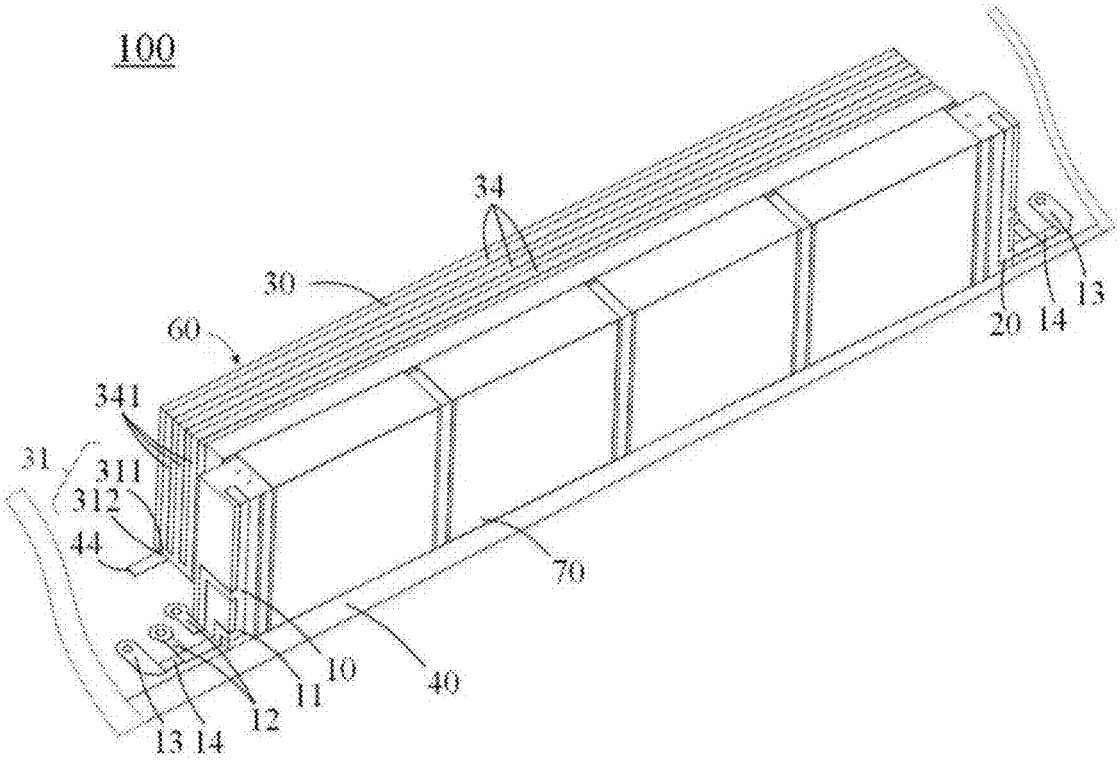
FIG. 1 is a perspective diagram of the antenna structure according to embodiment 1 of the present disclosure.

In the following, the technical scheme in the embodiments of the present disclosure will be described clearly and completely with reference to the drawings in the embodiments of the present disclosure. Obviously, the described embodiments are only some embodiments of the present disclosure, rather than all of the embodiments. Based on the embodiments of the present disclosure, all other embodiments obtained by those skilled in the art without paying creative labor belong to the scope of protection of the present disclosure.

In the present disclosure, the orientation or positional relationship indicated by the terms "upper", "lower", "left", "right", "front", "rear", "top", "bottom", "inner", "outer", "middle", "vertical", "horizontal", "lateral" and "longitudinal" is based on the orientation or positional relationship shown in the drawings. These terms are mainly used to better describe the present disclosure and its embodiments, but are not used to define that the indicated devices, elements or components must have a specific orientation, or be constructed and operated in a specific orientation.

In addition, some of the above terms can be used not only to express the orientation or positional relationship, but also to express other meaning. For example, the term "upper" may also be used to express a certain dependency or connection relationship in some cases. For those skilled in the art, the specific meanings of these terms in the present disclosure can be understood according to specific situations.

In addition, the terms "install", "provide", "provided with", "connect" and "link" should be understood in a broad sense. For example, it can be fixedly connected, detachably connected, or integrally constructed; it can be mechanically connected or electrically connected; it can be directly connected, indirectly connected through an intermediate medium, or internally communicated between two devices, elements or components. For those skilled in the art, the specific meanings of the above terms in the present disclosure can be understood according to specific situations.

In addition, the terms "first", "second", etc. are mainly used to distinguish different devices, elements or components (the specific types and configurations may be the same or different), but are not used to indicate or imply the relative importance and quantity of the indicated devices, elements or components. Unless otherwise specified, "a plurality of" means two or more.

Embodiment 1

Figure 2:
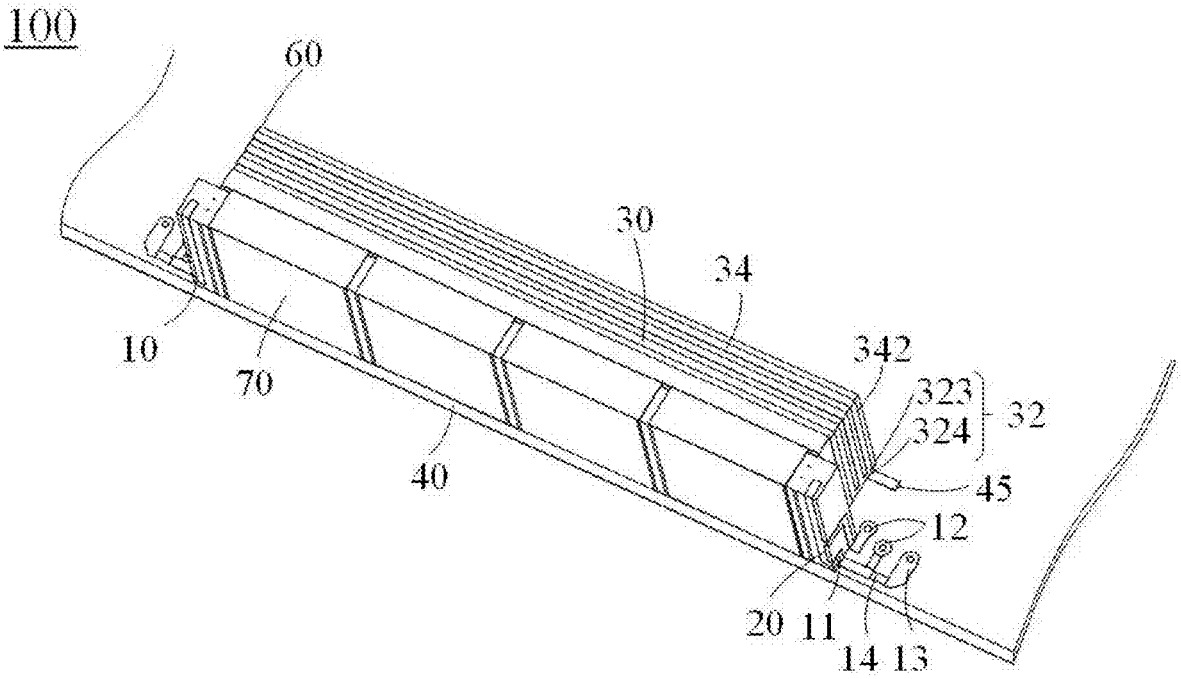
FIG. 2 is a perspective diagram of the antenna structure shown in FIG. 1 from another angle.
Figure 3:
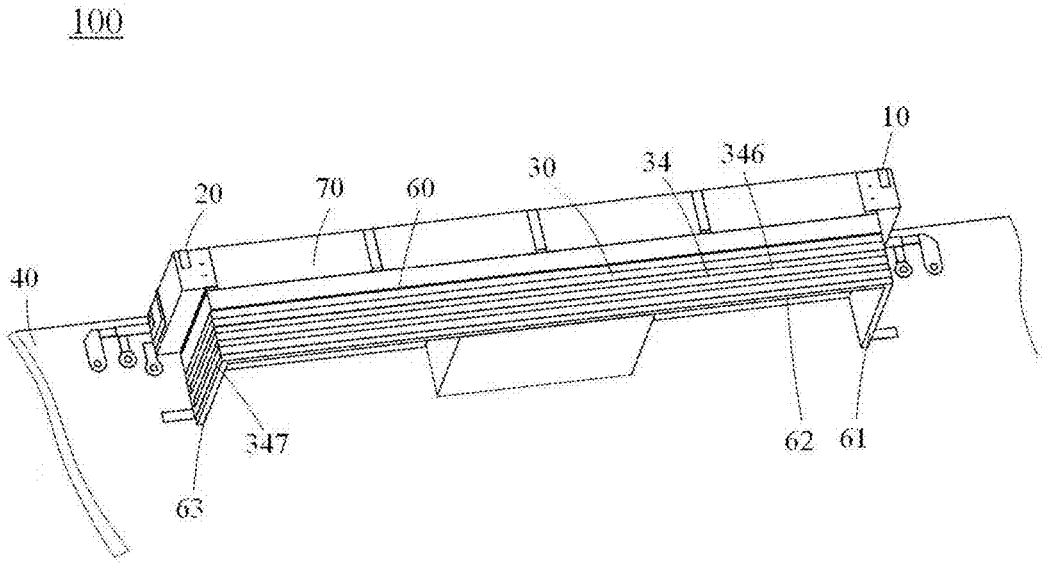
FIG. 3 is a perspective diagram of the antenna structure shown in FIG. 1 from still another angle.

Refer to FIG. 1 and FIG. 2. FIG. 1 is a perspective diagram of the antenna structure according to embodiment 1 of the present disclosure. FIG. 2 and FIG. 3 are perspective diagrams of the antenna structure shown in FIG. 1 from different angles. In an embodiment, an antenna structure 100 according to the embodiment of the present disclosure comprises a first antenna 10, a second antenna 20 and a three-dimensional decoupling structure 30 located on at least two planes, wherein the three-dimensional decoupling structure 30 comprises a conductor, and at least part of the three-dimensional decoupling structure 30 is located in the space between the first antenna 10 and the second antenna 20.

It can be understood that the space between the first antenna 10 and the second antenna 20 can be a three-dimensional space, which comprises not only the middle space between the first antenna 10 and the second antenna 20 (such as the space through which any connecting line between the first antenna 10 and the second antenna 20 passes), but also the space to which the middle space between the first antenna 10 and the second antenna 20 further extends. For example, in the embodiment shown in FIGS. 1-3, at least part (e.g., the middle part) of the three-dimensional decoupling structure 30 is not located in the middle space between the first antenna 10 and the second antenna 20. Specifically, the three-dimensional decoupling structure 30 is located at one side of the first antenna 10 and the second antenna 20, and at least part (e.g., the middle part) of the three-dimensional decoupling structure 30 is located in the space to which the middle space between the first antenna 10 and the second antenna 20 further extends towards the three-dimensional decoupling structure 30.

The first antenna 10 and the second antenna 20 may be antennas operating at the same frequency or different frequencies. In the embodiment shown in FIGS. 1 to 3, the first antenna 10 and the second antenna 20 are provided on opposite sides of the first structure 70 at intervals, and are respectively electrically connected with the circuit board 40. The first structure 70 can be an antenna array, an antenna carrier or support, a metal or other antennas, etc. In the embodiment shown in FIGS. 1 to 3, the first structure 70 is an antenna support, and at least part of the first antenna 10 and the second antenna 20 are provided on the first structure 70. It can be understood that the first antenna 10 and the second antenna 20 are electrically connected to the circuit board 40, which is conducive to improving the compactness and miniaturization of the overall structure. In addition, the first antenna 10 and the second antenna 20 may also be three-dimensional structures, which are located on at least two planes, such as two different planes of the first structure 70. The antenna with the above structure causes the antenna structure to have higher design freedom, achieve more quantifiable, more accurate and faster design, and have more opportunities to improve manufacturability and reduce the size of the antenna structure.

The three-dimensional decoupling structure 30 is carried by the three-dimensional decoupling structure support 60 provided on the circuit board 40. The three-dimensional decoupling structure support 60 is approximately a rectangular structure, and the three-dimensional decoupling structure 30 is provided on three continuous planes of the rectangular structure. It can be understood that, in some embodiments, the three-dimensional decoupling structure 30 can only be provided on two continuous planes of the three-dimensional decoupling structure support 60, such as the top surface and one of the side surfaces.

The three-dimensional decoupling structure support 60 comprises a first side surface 61, atop surface 62 and a second side surface 63. The three-dimensional decoupling structure 30 can be provided on the first side surface 61 and the top surface 62, the second side surface 63 and the top surface 63, or the first side surface 61, the top surface 62 and the third side surface 63. It can be understood that the three-dimensional decoupling structure support 60 is not limited to the square structure shown in the figure, but can also be any suitable three-dimensional structure, such as T-shaped or cylindrical structure. Preferably, the three-dimensional decoupling structure support 60 is provided adjacent to the first structure 70, and its structure is matched with the first structure 70. The top surface 62 of the three-dimensional decoupling structure support 60 is adjacent to the top surface of the first structure 70, so that the top surface 62 of the three-dimensional decoupling structure support 60 is located in the space between the first antenna 10 and the second antenna 20. Matching the shape of the three-dimensional decoupling structure support 60 with that of the first structure 70 can improve the integrity and consistency of the structure.

Figure 4:
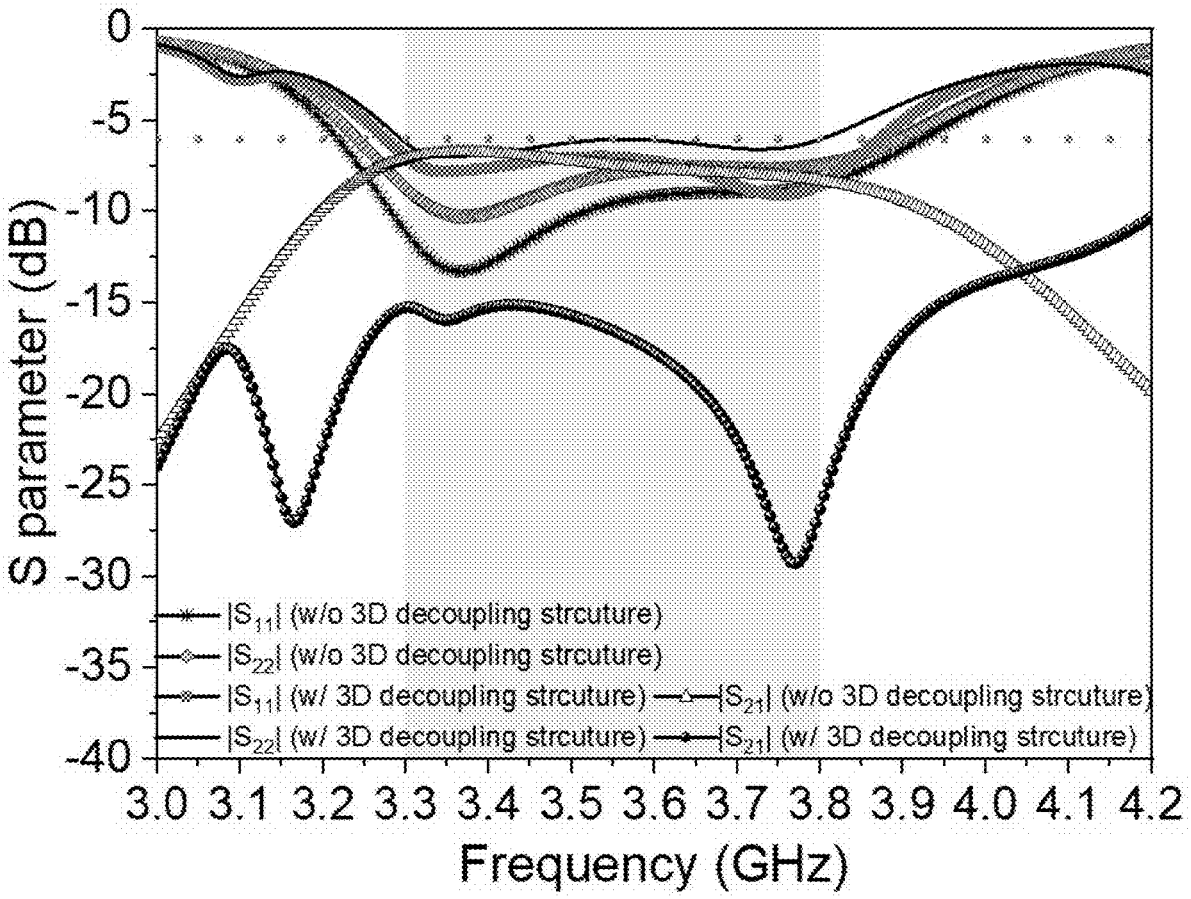
FIG. 4 is a comparison diagram of tested signals between the antenna structure shown in FIG. 1 and the existing antenna structure.

Refer to FIG. 4, which is a performance comparison diagram between the antenna comprising the three-dimensional decoupling structure 30 and the antenna without the three-dimensional decoupling structure 30. In this embodiment of the present disclosure, the in-band peak isolation level (i.e., $|S_{21}|$) of the two antennas has increased by about 8.5 dB compared with the antenna without the three-dimensional decoupling structure, and in-band the isolation level of the antennas is better than 15 dB, so that the decoupling performance is good, which can effectively reduce the degradation degree of antenna performance caused by coupling.

Compared with the prior art, the antenna decoupling effect can be effectively achieved through the three-dimensional decoupling structure 30, so that the degradation degree of antenna performance due to coupling can be reduced, and meanwhile, the three-dimensional space of the system can be better utilized, that is, the occupied horizontal area in the system can be reduced, so that the utilization rate of limited space can be improved, and a projected clearance area (i.e., area without conductors) does not need to be provided on the board, so that the integrity of the system motherboard can be better maintained and the decoupling performance can be prevented from being affected by the metal environment or component(s) under the board; therefore, in summary, it can obviously enhance the comprehensive competitiveness of products.

Furthermore, the three-dimensional decoupling structure 30 is independent of both the first antenna 10 and the second antenna 20 in electrical connection. The electrical connection independence mainly means that there is no direct physical connection between any two of the three-dimensional decoupling structure 30 and the first antenna 10 and the second antenna 20. It can be understood that the three-dimensional decoupling structure 30 has more flexible design freedom through independent design of electrical connection, so as to reduce the influence on the original antenna target performance, and achieve effective decoupling effect, so as to reduce the degradation degree of antenna performance due to coupling, thus ensuring or improving the wireless communication experience of users. In addition, the signals applied to the three-dimensional decoupling structure 30, the first antenna 10 and the second antenna 20 can be further independently controlled by the above electrical connection design, which is beneficial to ensuring or enhancing the communication experience of users.

In the embodiment shown in FIGS. 1-3, the first antenna 10 and the second antenna 20 both comprise an antenna main body 11, a grounding part 12 connected to the antenna main body 11, an antenna feed source part 13 connected to the antenna main body 11 and a matching network part 14 connected to the antenna main body 11. At least parts of the grounding part 12, the antenna feed source part 13 and the matching network part 14 are provided on the circuit board 40. The first antenna 10 and the second antenna 20 can be effectively electrically connected with the circuit board 40 through the structured corresponding arrangement. It can be understood that the first antenna 10 and the second antenna 20 are electrically connected with conductor wiring on the circuit board 40, which can effectively improve the decoupling performance of the antenna and effectively utilize its spatial structure, thereby reducing the production cost and improving the production efficiency of the antenna structure 100. In this embodiment, the first antenna 10 and the second antenna 20 are both electrically connected with (the components or conductor wiring on) the circuit board 40 (e.g., electrically connected with the components or conductor wiring on the circuit board 40 through the grounding part 12, the antenna feed source part 13 and the matching network part 14), but in other embodiments, the first antenna 10 and the second antenna 10 can also be respectively electrically coupled with the components or conductor wiring on the circuit board 40 to realize the interaction of electrical signals. The first antenna 10 and the second antenna 20 are electrically connected or coupled directly with the circuit board 40, which is conducive to improving the compactness and miniaturization of the overall structure.

Specifically, the three-dimensional decoupling structure 30 comprises at least one conductive wire, which can be specifically a conductive metal wire. The at least conductive one wire may be provided on at least two planes. Each conductive wire, comprises two opposite ends, and at least one of the two opposite ends can be electrically connected or not electrically connected with the circuit board, so that diversified circuit connection requirements can be realized. The three-dimensional decoupling structure 30 is formed by the conductive wires, which is beneficial to reducing the production cost and improving the production efficiency of the three-dimensional decoupling structure 30, and also beneficial to reducing the volume of the three-dimensional decoupling structure 30, thereby reducing the occupied space. In addition, the three-dimensional decoupling structure 30 is independent of the first antenna 10 and the second antenna 20 in electrical connection, which can effectively achieve antenna decoupling effect and reduce the degradation degree of antenna performance due to coupling.

In some embodiments, the three-dimensional decoupling structure 30 comprises at least two conductive wires, which can be provided in parallel at intervals. It can be understood that in other embodiments, the at least two wires may also be provided in unparallel at intervals. The conductive wire can be provided in a straight line or be bent. It can be understood that at least two conductive wires are provided, so that the decoupling effect can be improved, and the effect of multi-frequency and broadband decoupling can be achieved, thereby ensuring or improving the communication experience of users.

In the embodiment shown in FIGS. 1 to 3, the three-dimensional decoupling structure 30 comprises three conductive wires 34 provided in parallel at intervals. It can be understood that the three conductive wires 34 can be provided at other intervals. For example, at least one of the wires 34 may be bent or the like.

Each of the conductive wires 34 comprises a first end 341, the first end 341 is connected with a first electrical connection part 31, and the first electrical connection part 31 is in electrical connection, electrical coupling or floating connection with the circuit board 40 (i.e., not electrically connected with or electrically coupled with the circuit board 40). In this embodiment, the first electrical connection part 3 is electrically connected with the circuit board 40. Specifically, the first electrical connection part 31 comprises a first part 311 and a second part 312, the first part 311 is connected between the first end 341 and the second part 312, the second part 312 is connected with the first terminal 44, the first terminal 44 is located on the circuit board 40, and at least part of the second part 312 extends to the circuit board 40, and the first part 311 and the second part 312 are on different planes.

Furthermore, each of the conductive wires 34 further comprises a second end 342 opposite to the first end 341, the second end 342 of each of the wires 34 can be electrically connected with a second electrical connection part 32, and the second electrical connection part 32 is in electrical connection, electrical coupling or floating connection with the circuit board 40. Specifically, in this embodiment, the second electrical connection part 32 is electrically connected with the second terminal 45 on the circuit board 40. In other embodiments, the second end 342 can also be in directly electrical connection, electrical coupling or floating connection with the circuit board 40, and the second electrical connection part 32 is not required.

It can be understood that in some embodiments, the first ends 341 of each of the conductive wires 34 can be electrically connected to the same first terminal 44 on the circuit board or different first terminals 44 on the circuit board 40 independently. The second ends 342 of each of the wires 34 can be electrically connected to the same second terminal 45 on the circuit board 40 or different second terminals 45 on the circuit board 40 independently. The electrical connection or disconnection between the wire 34 and the circuit board 40 can be provided according to actual electrical connection requirements, so as to meet various electrical connection requirements.

In detail, the second electrical connection part 32 comprises a third part 323 and a fourth part 324, the third part 323 is connected between the second end 342 and the fourth part 324, the fourth part 324 is connected to the second terminal 45, at least part of the fourth part 324 located on the circuit board 40, and the third part 323 and the fourth part 324 are on different planes.

The first electrical connection part 31 and the second electrical connection part 32 can effectively electrically connect the wire 34 with the circuit board 40, which is also beneficial to improving the production efficiency, reducing the production cost and reducing the volume of the antenna structure 10.

It can be understood that the conductive wire 34 can be a conductive metal line formed on the three-dimensional decoupling structure support 60, a conductive line formed on a flexible printed circuit board, or a conductive cable, and is not limited thereto. The three-dimensional decoupling structure support 60 may be an insulating material with certain rigidity, for example but not limited to plastic, and in a modified embodiment, when the three-dimensional decoupling structure is a metal sheet structure with certain rigidity, the three-dimensional decoupling structure support 60 may also be omitted.

Embodiment 2

Figure 5:
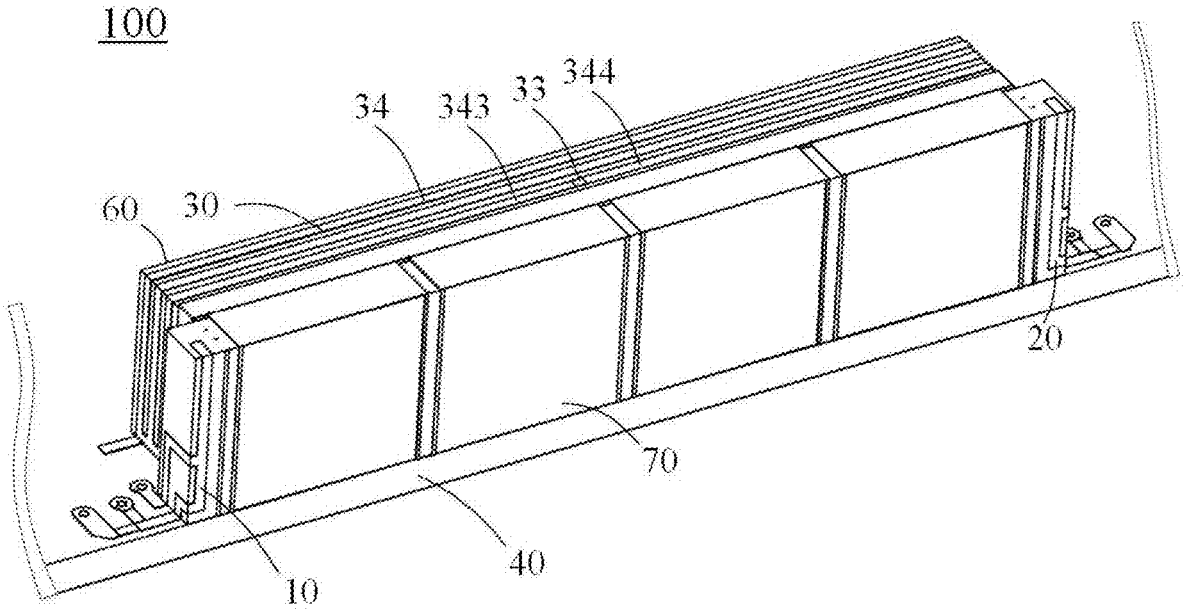
FIG. 5 is a perspective diagram of the antenna structure according to embodiment 2 of the present disclosure.

Refer to FIG. 5, which is a perspective diagram of the antenna structure according to embodiment 2 of the present disclosure. The part in which the scheme of the antenna structure 100 in this embodiment is the same as that in embodiment 1 will not be described in detail, and the differences of the antenna structure 100 in this embodiment will be described emphatically.

In embodiment 2, the three-dimensional decoupling structure 30 comprises at least one conductive wire 34, the wire 34 comprises a first conductive wire part 343 and a second conductive wire part 344, and the first conductive wire part 343 and the second conductive wire part 344 are electrically connected by a third electrical connection part 33. The third electrical connection part 33 comprises one, two or more other conductive wire(s), active electronic component(s) and passive electronic component(s). Specifically, the active electronic component comprises a switching element, such as a transistor or a micro-electro-mechanical system (MEMS), or an adjustable component part. The adjustable component part can be an adjustable capacitor, an adjustable inductor, or a switching component, so as to help the impedance between the feed source part and the antenna main body to be more matched or adjust/switch the operating frequency of the antenna. The passive electronic component, comprises at least one of an inductor, a capacitor and a resistor, or a circuit structure consisted of at least one, two or more of inductor(s), capacitor(s) and resistor(s).

Compared with embodiment 1, the third electrical connection part 33 is provided, so that the three-dimensional decoupling structure 30 and the antenna structure 100 have higher design freedom, achieve more quantifiable, more accurate and faster design, and have the opportunity to improve manufacturability and reduce the size of the decoupling structure and the antenna structure 100.

Embodiment 3

Figure 6:
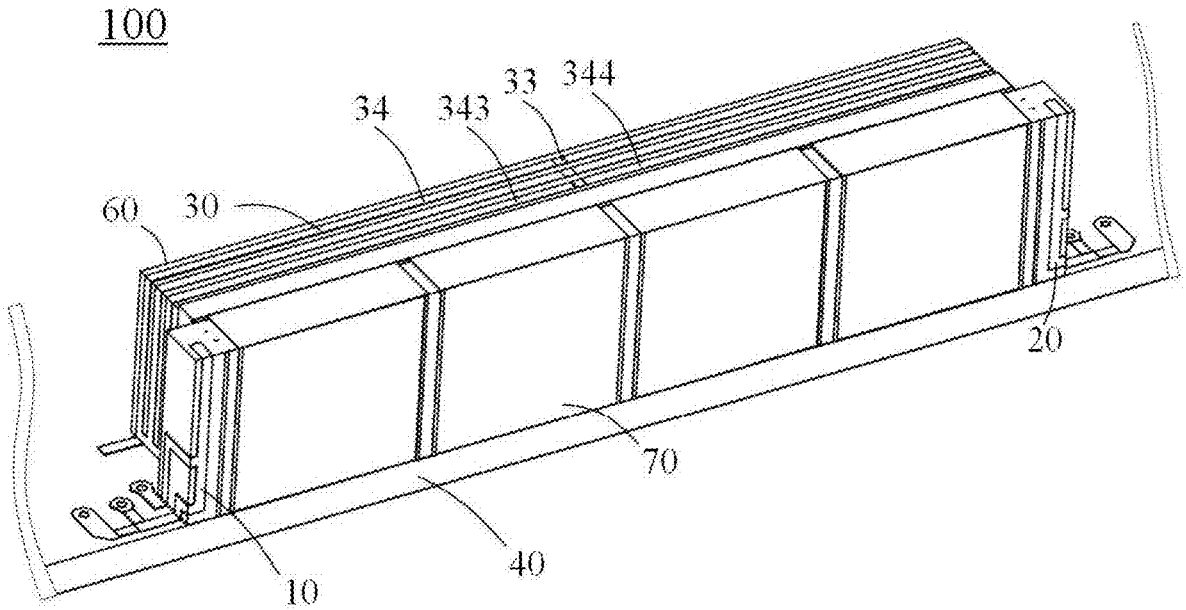
FIG. 6 is a perspective diagram of the antenna structure according to embodiment 3 of the present disclosure.

Refer to FIG. 6, which is a perspective diagram of the antenna structure according to embodiment 3 of the present disclosure. The part in which the scheme of the antenna structure 100 in this embodiment is the same as that in embodiment 1 will not be described in detail, and the differences of the antenna structure 100 in this embodiment will be described emphatically.

In embodiment 3, the three-dimensional decoupling structure 30 comprises three conductive wires 34, each of the conductive wires 34 comprises a first conductive wire part 343 and a second conductive wire part 344, and the first conductive wire part 343 and the corresponding second conductive wire part 344 are electrically connected by a third electrical connection part 33.

Furthermore, the third electrical connection part 33 comprises one, two or more of other conductive wire(s), active electronic component(s) and passive electronic component(s). Specifically, the active electronic component comprises a switching element, such as a transistor or a micro-electro-mechanical system (MEMS), or an adjustable component part. The adjustable component part can be an adjustable capacitor, an adjustable inductor, or a switching component, so as to help the impedance between the feed source part and the antenna main body to be more matched or adjust/switch the operating frequency of the antenna. The passive electronic component comprises at least one of an inductor, a capacitor and a resistor, or a circuit structure consisted of at least one, two or more of inductor(s), capacitor(s) and resistor(s).

Compared with embodiment 1, the third electrical connection part 33 is provided, so that the three-dimensional decoupling structure 30 and the antenna structure 100 have higher design freedom, achieve more quantifiable, more accurate and faster design, and have the opportunity to improve manufacturability and reduce the size of the decoupling structure and the antenna structure 100.

Embodiment 4

Figure 7:
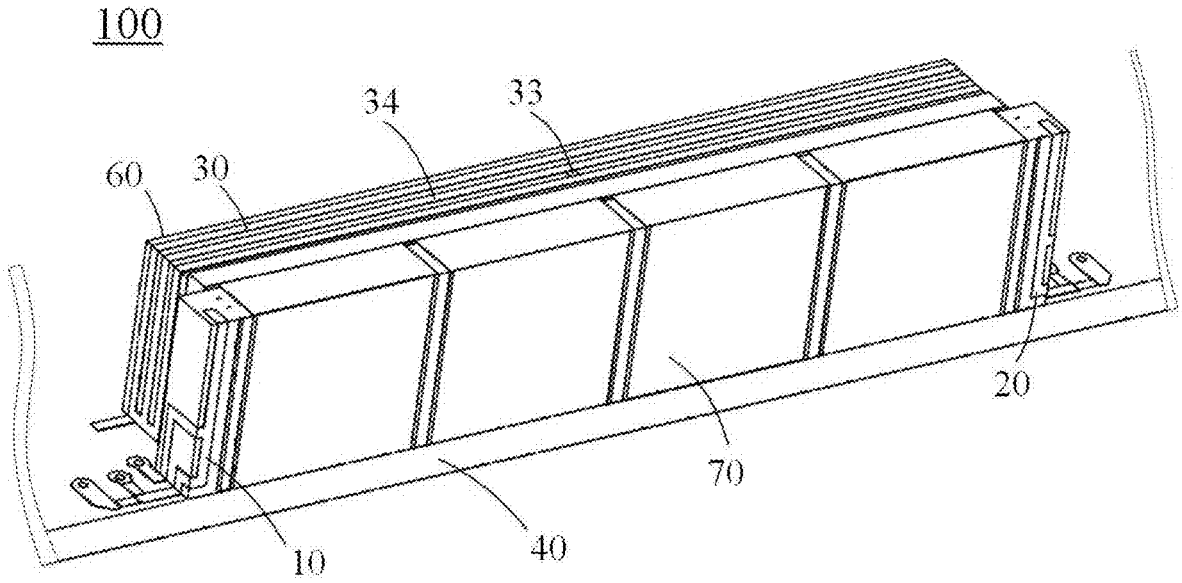
FIG. 7 is a perspective diagram of the antenna structure according to embodiment 4 of the present disclosure.

Refer to FIG. 7, which is a perspective diagram of the antenna structure according to embodiment 4 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 4, there are three conductive wires 34, and two adjacent conductive wires 34 are electrically connected by the third electrical connection part 33.

Furthermore, the third electrical connection part 33 comprises one, two or more of other conductive wire(s), active electronic component(s) and passive electronic component(s). Specifically, the active electronic component comprises a switching element, such as a transistor or a micro-electro-mechanical system (MEMS), or an adjustable component part. The adjustable component can be an adjustable capacitor, an adjustable inductor, or a switching component, so as to help the impedance between the feed source part and the antenna main body to be more matched or adjust/switch the operating frequency of the antenna. The passive electronic component comprises at least one of an inductor, a capacitor and a resistor, or a circuit structure consisted of at least one, two or more of inductor(s), capacitor(s) and resistor(s).

Compared with embodiment 1, the third electrical connection part 33 is provided, so that the three-dimensional decoupling structure 30 and the antenna structure 100 have higher design freedom, achieve more quantifiable, more accurate and faster design, and have the opportunity to improve manufacturability and reduce the size of the decoupling structure and the antenna structure 100.

Embodiment 5

Figure 8:
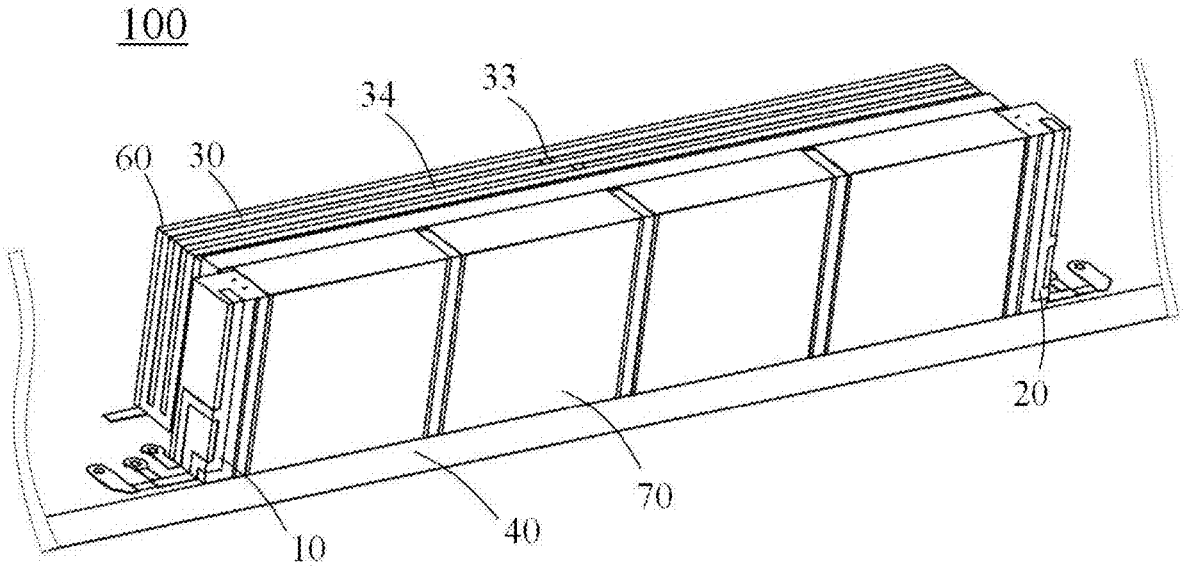
FIG. 8 is a perspective diagram of the antenna structure according to embodiment 5 of the present disclosure.

Refer to FIG. 8, which is a perspective diagram of the antenna structure according to embodiment 5 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 5, there are three wires 34, and two adjacent conductive wires 34 are electrically connected by a third electrical connection part 33.

Furthermore, two adjacent third electrical connection parts 33 are provided in a staggered manner. It can be understood that, in a modified embodiment, two adjacent third electrical connection parts 33 are located opposite to each other.

The third electrical connection part 33 comprises one, two or more of other conductive wire(s), active electronic component(s) and passive electronic component(s). Specifically, the active electronic component comprises a switching element, such as a transistor or a micro-electro-mechanical system (MEMS), or an adjustable component part. The adjustable component part can be an adjustable capacitor, an adjustable inductor, or a switching component, so as to help the impedance between the feed source part and the antenna main body to be more matched or adjust/switch the operating frequency of the antenna. The passive electronic component comprises at least one of an inductor, a capacitor and a resistor, or a circuit structure consisted of at least one, two or more of inductor(s), capacitor(s) and resistor(s).

Compared with embodiment 1, the third electrical connection part 33 is provided, so that the three-dimensional decoupling structure 30 and the antenna structure 100 have higher design freedom, achieve more quantifiable, more accurate and faster design, and have the opportunity to improve manufacturability and reduce the size of the decoupling structure and the antenna structure 100.

Embodiment 6

Figure 9:
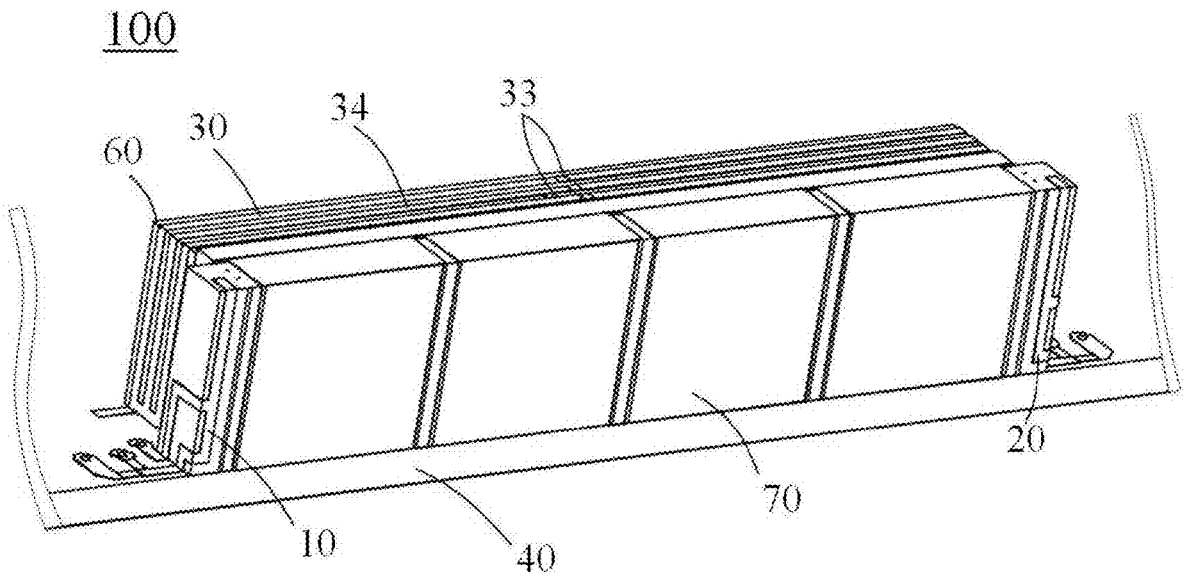
FIG. 9 is a perspective diagram of the antenna structure according to embodiment 6 of the present disclosure.

Refer to FIG. 9, which is a perspective diagram of the antenna structure according to embodiment 6 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 6, the three-dimensional decoupling structure 30 comprises three conductive wires 34, any of the wires 34 comprises a first conductive wire part 343 and a second conductive wire part 344, and the first conductive wire part 343 and the second conductive wire part 344 are electrically connected by a third electrical connection part 33.

Furthermore, two adjacent conductive wires 34 are electrically connected by a third electrical connection part 33.

The third electrical connection part 33 comprises one, two or more of other conductive wire(s), active electronic component(s) and passive electronic component(s). Specifically, the active electronic component comprises a switching element, such as a transistor or a micro-electro-mechanical system (MEMS), or an adjustable component part. The adjustable component part can be an adjustable capacitor, an adjustable inductor, or a switching component, so as to help the impedance between the feed source part and the antenna main body to be more matched or adjust/switch the operating frequency of the antenna. The passive electronic component comprises at least one of an inductor, a capacitor and a resistor, or a circuit structure consisted of at least one, two or more of inductor(s), capacitor(s) and resistor(s).

Compared with embodiment 1, the third electrical connection part 33 is provided, so that the three-dimensional decoupling structure 30 and the antenna structure 100 have higher design freedom, achieve more quantifiable, more accurate and faster design, and have the opportunity to improve manufacturability and reduce the size of the decoupling structure and the antenna structure 100.

Embodiment 7

Figure 10:
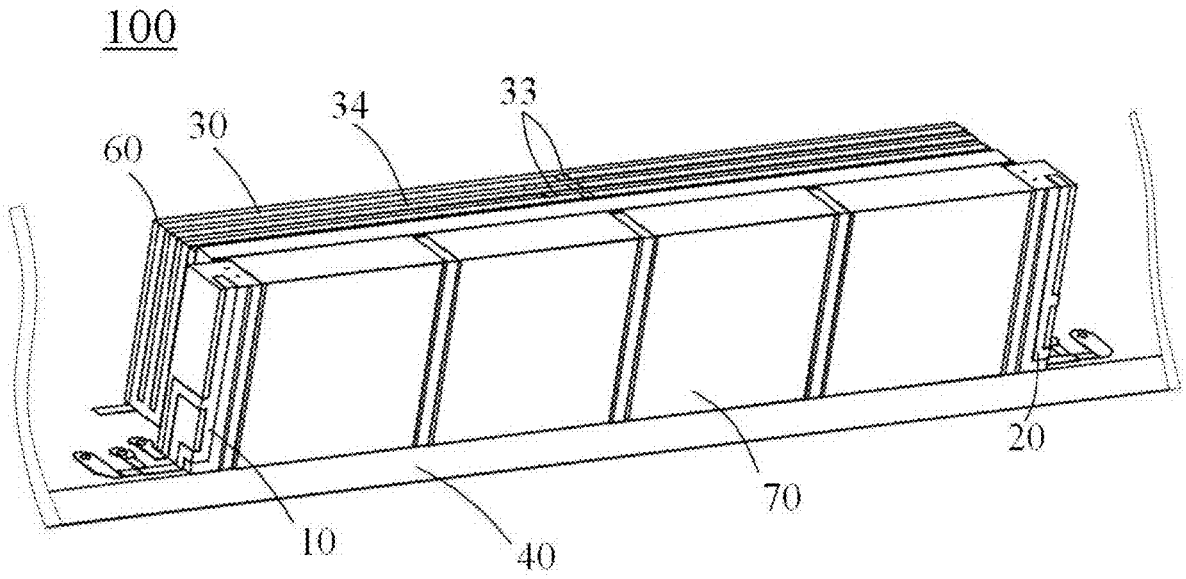
FIG. 10 is a perspective diagram of the antenna structure according to embodiment 7 of the present disclosure.

Refer to FIG. 10, which is a perspective diagram of the antenna structure according to embodiment 7 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 7, the three-dimensional decoupling structure 30 comprises three conductive wires 34, any of the wires 34 comprises a first conductive wire part 343 and a second conductive wire part 344, and the first conductive wire part 343 and the second conductive wire part 344 are electrically connected by a third electrical connection part 33.

Furthermore, any two adjacent conductive wires 34 are electrically connected by a third electrical connection part 33. In detail, two adjacent third electrical connection parts 33 are provided in a staggered manner. It can be understood that, in a modified embodiment, two adjacent third electrical connection parts 33 are located opposite to each other.

Furthermore, the third electrical connection part 33 comprises one, two or more of other conductive wire(s), active electronic component(s) and passive electronic component(s). Specifically, the active electronic component comprises a switching element, such as a transistor (such as a MOS). The passive electronic component comprises at least one of an inductor, a capacitor and a resistor, or a circuit structure consisted of at least one, two or more of inductor(s), capacitor(s) and resistor(s).

Compared with embodiment 1, the third electrical connection part 33 is provided, so that the three-dimensional decoupling structure 30 and the antenna structure 100 have higher design freedom, achieve more quantifiable, more accurate and faster design, and have the opportunity to improve manufacturability and reduce the size of the decoupling structure and the antenna structure 100.

Embodiment 8

Figure 11:
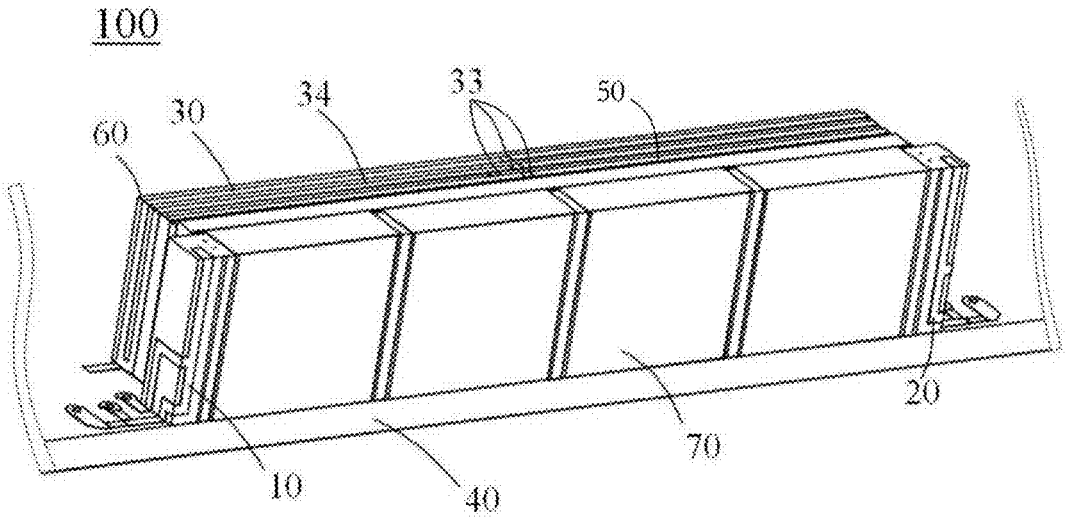
FIG. 11 is a perspective diagram of the antenna structure according to embodiment 8 of the present disclosure.

Refer to FIG. 11, which is a perspective diagram of the antenna structure according to embodiment 8 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

The antenna structure 100 further comprises a planar decoupling structure 50, and the planar decoupling structure 50 and the three-dimensional decoupling structure 30 are electrically connected by a third electrical connection part 33. The planar decoupling structure 50 is provided on the top surface of the three-dimensional decoupling structure support 60, and is provided in parallel with the three-dimensional decoupling structure 30 at intervals. It can be understood that in other embodiments, the planar decoupling structure 50 can also be provided on other surfaces of the three-dimensional decoupling structure support 60, and is electrically connected with the three-dimensional decoupling structure through the third electrical connection part 33 or is directly electrically connected with the circuit board.

The third electrical connection part 33 comprises one, two or more of other conductive wire(s), active electronic component(s) and passive electronic component(s). Specifically, the active electronic component comprises a switching element, such as a transistor or a micro-electro-mechanical system (MEMS), or an adjustable component part. The adjustable component part can be an adjustable capacitor, an adjustable inductor, or a switching component, so as to help the impedance between the feed source part and the antenna main body to be more matched or adjust/switch the operating frequency of the antenna. The passive electronic component comprises at least one of an inductor, a capacitor and a resistor, or a circuit structure consisted of at least one, two or more of inductor(s), capacitor(s) and resistor(s).

The planar decoupling structure 50 is added and is electrically connected with the three-dimensional decoupling structure 30, so that the decoupling structure and the antenna structure 100 can have higher design freedom, achieve more quantifiable, more accurate and faster design, effectively improve the decoupling performance of the antenna, increase the design freedom and more performance control of the decoupling structure and the antenna structure, and further ensure or improve the communication experience of users.

Embodiment 9

Figure 12:
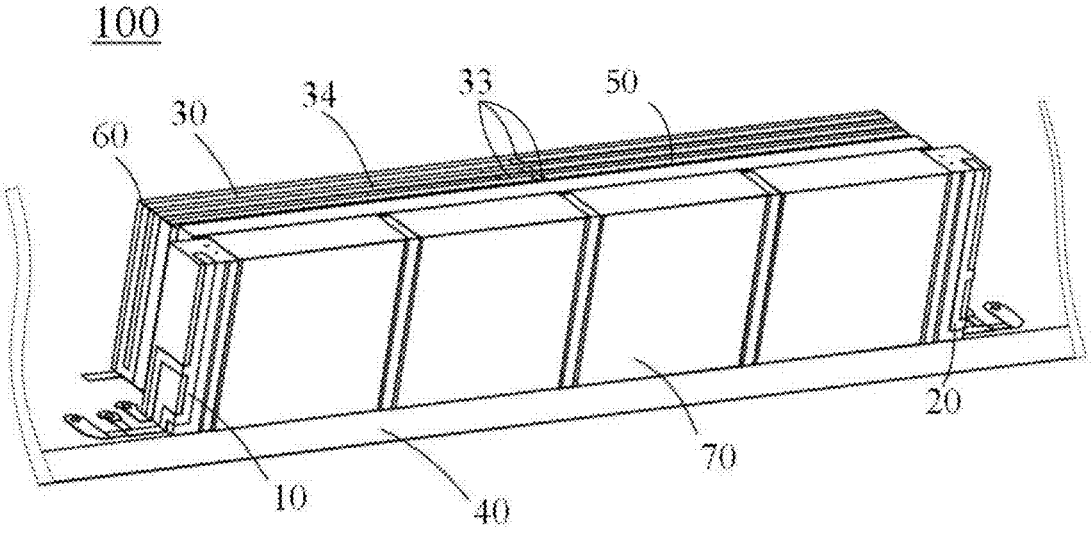
FIG. 12 is a perspective diagram of the antenna structure according to embodiment 9 of the present disclosure.

Refer to FIG. 12, which is a perspective diagram of the antenna structure according to embodiment 9 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 9, the three-dimensional decoupling structure 30 comprises a conductive wire 34. It can be understood that the structure design of one wire 34 is simple, so that the three-dimensional decoupling structure 30 have a simple and stable structure, and can also achieve the required decoupling effect, such as a relatively stable single-frequency decoupling effect.

Embodiment 10

Figure 13:
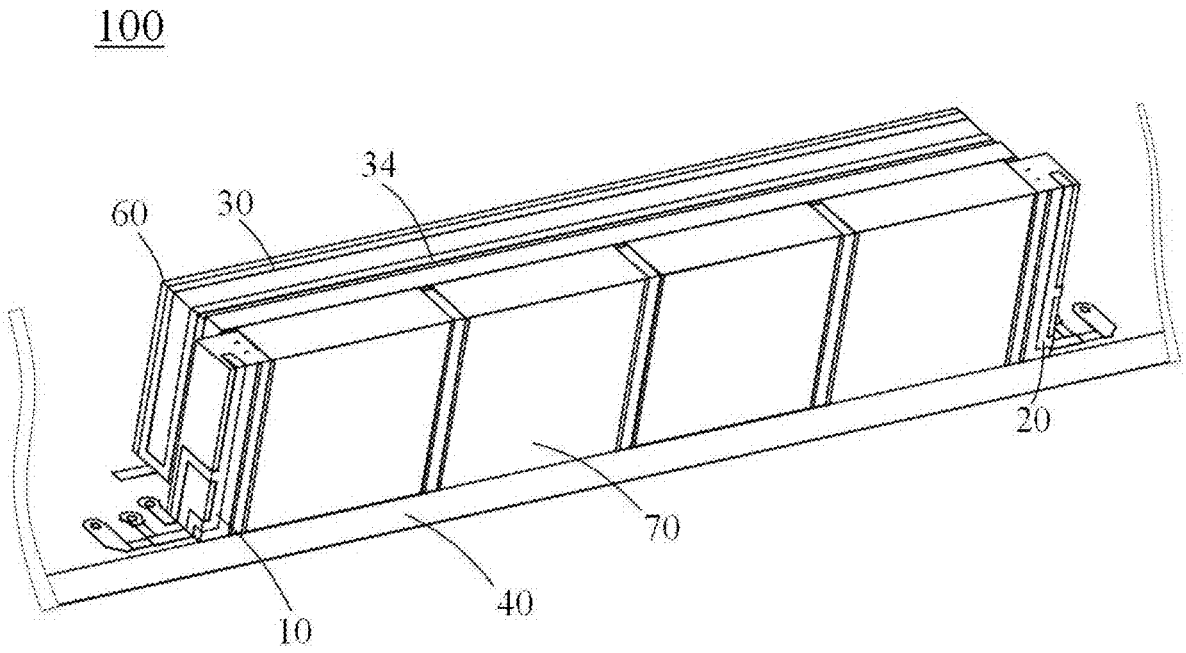
FIG. 13 is a perspective diagram of the antenna structure according to embodiment 10 of the present disclosure.

Refer to FIG. 13, which is a perspective diagram of the antenna structure according to embodiment 10 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 10, the three-dimensional decoupling structure 30 comprises two conductive wires 34, and the two wires 34 are provided in parallel at intervals. The structure of the three-dimensional decoupling structure 30 of the embodiment is also relatively simple, so that the three-dimensional decoupling structure 30 has higher design freedom, and can achieve the effect of multi-frequency and broadband decoupling.

Embodiment 11

Figure 14:
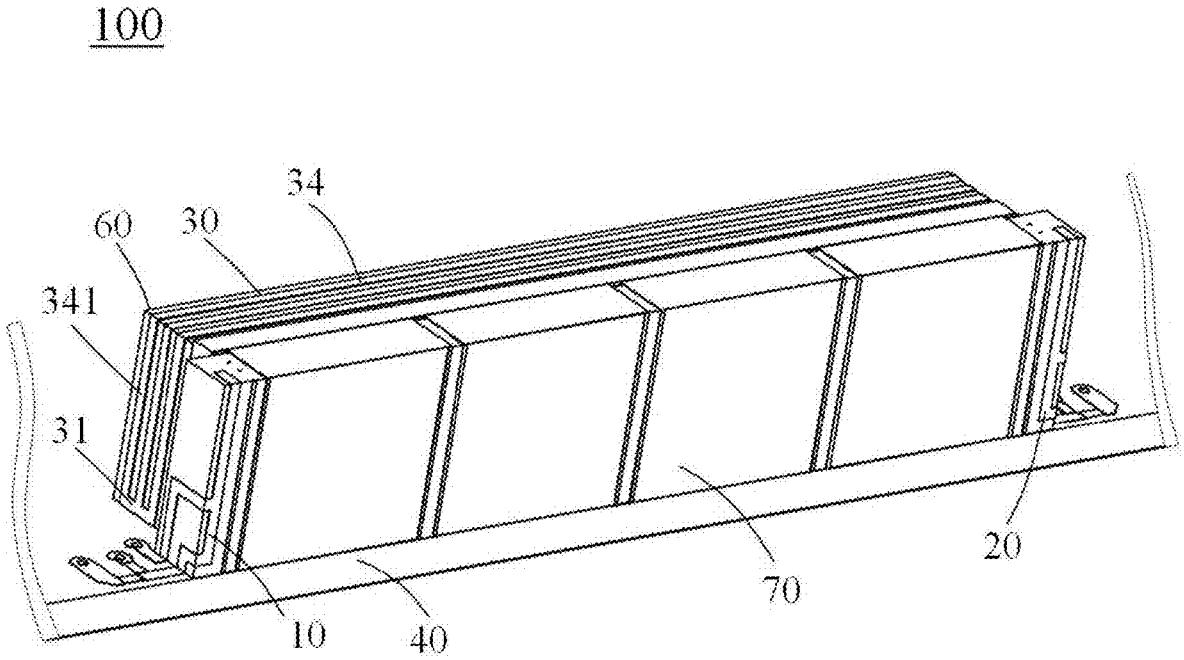
FIG. 14 is a perspective diagram of the antenna structure according to embodiment 11 of the present disclosure.

Refer to FIG. 14, which is a perspective diagram of the antenna structure according to embodiment 11 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 11, the wire 34 comprises a first end 341 and a second end 342 opposite to the first end 341, the first ends 341 of the conductive wires 34 are electrically connected through a first electrical connection part 31, and the first electrical connection part 31 can be in electrical connection, electrical coupling or floating connection with the circuit board 40.

Furthermore, the second ends 342 of the conductive wires 34 are electrically connected through the second electrical connection part 32. It can be understood that the second electrical connection part 32 can also be in electrical connection, electrical coupling or floating connection with the circuit board 40.

Through the design of the above electrical connection method, the three-dimensional decoupling structure 30 and the antenna structure 100 can also have higher design freedom, achieve more quantifiable, more accurate and faster design, and have more opportunities to improve manufacturability and reduce the size of the decoupling structure and the antenna structure 100.

Embodiment 12

Figure 15:
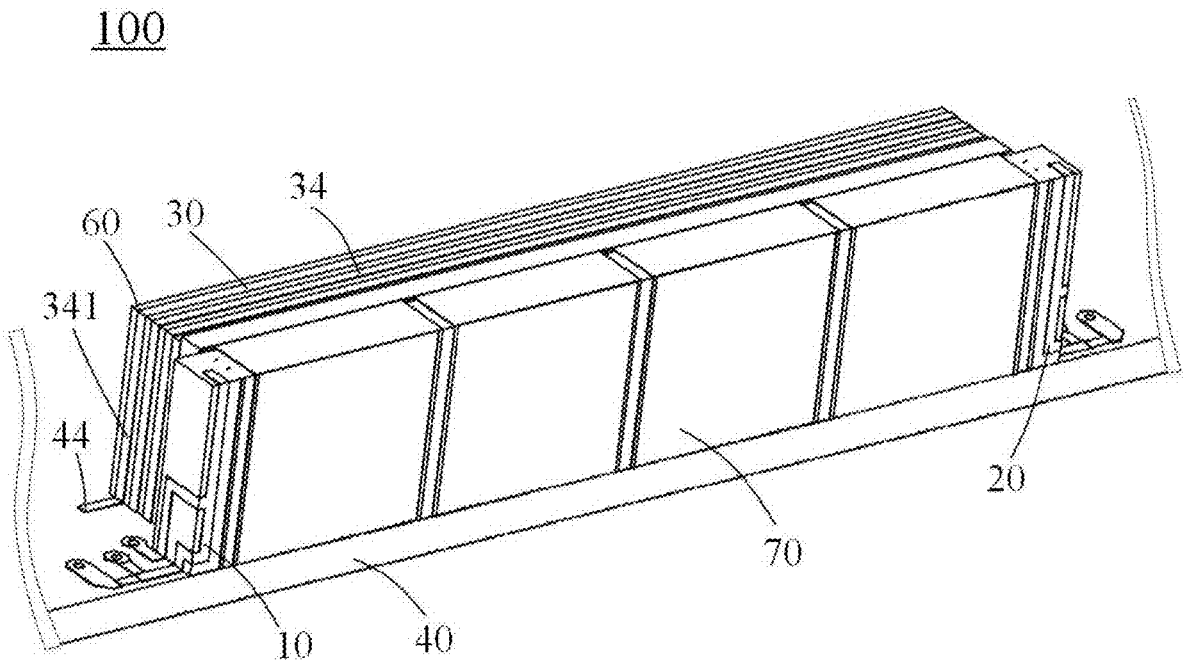
FIG. 15 is a perspective diagram of the antenna structure according to embodiment 12 of the present disclosure.

Refer to FIG. 15, which is a perspective diagram of the antenna structure according to embodiment 12 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 12, there are three conductive wires 34, and the opposite ends of at least one of the wires 34 can be in electrical connection, electrical coupling or floating connection with the circuit board 40.

Specifically, in this embodiment, the wire 34 comprises a first end 341 and a second end 342 opposite to the first end 341, the first ends 341 of the wires 34 are not connected at the end, and the first end 341 of one of the three conductive wires 34 is electrically connected to the first terminal 44. In a modified embodiment, the first ends 341 of the conductive wires 34 are not connected at the end, and the first end 341 of one of the three conductive wires 34 is electrically connected to the first terminal 44. Furthermore, the second end 342 of the wire 34 may be electrically connected, electrically coupled or not connected to the circuit board 40. In a modified embodiment, one end of the first end 341 and the second end 342 is in electrical connection, electrical coupling or floating connection with the circuit board 40.

Through the design of the above electrical connection method, the three-dimensional decoupling structure 30 and the antenna structure 100 can also have higher design freedom, achieve more quantifiable, more accurate and faster design, and have more opportunities to improve manufacturability and reduce the size of the decoupling structure and the antenna structure 100.

Embodiment 13

Figure 16:
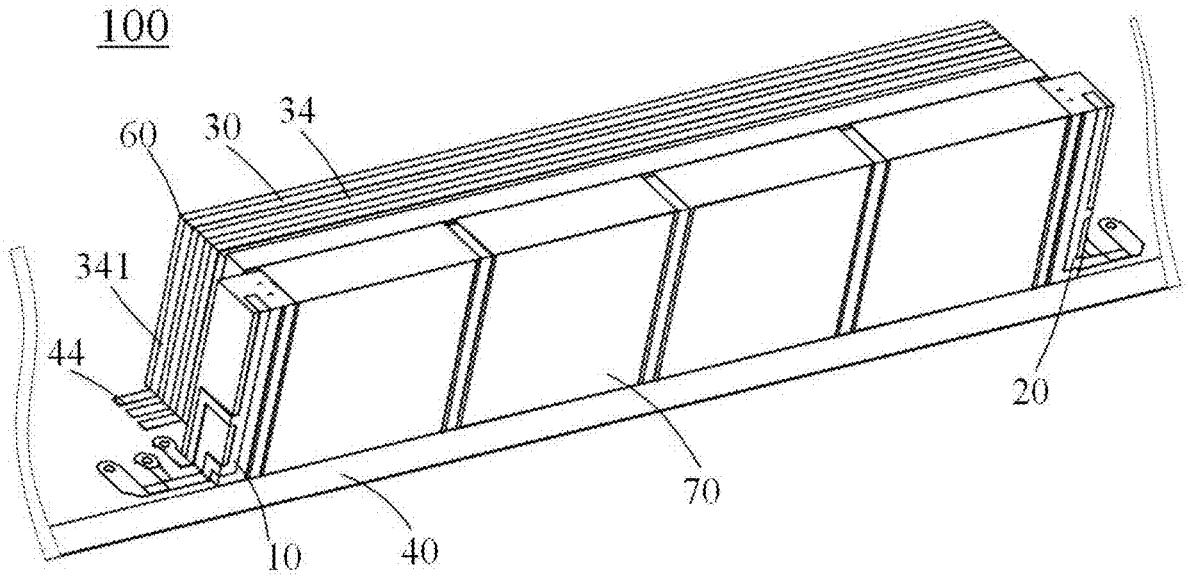
FIG. 16 is a perspective diagram of the antenna structure disclosed in Embodiment 13 of the present disclosure.

Refer to FIG. 16, which is a perspective diagram of the antenna structure according to embodiment 13 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 13, there are three wires 34, and the opposite ends of at least one of the conductive wires 34 can be in electrical connection, electrical coupling or floating connection with the circuit board 40. Specifically the conductive wire 34 comprises a first end 341 and a second end 342 opposite to the first end 341, and the first ends 341 of the three conductive wires 34 are electrically connected to a first terminal 44, respectively.

Furthermore, the second end 342 of the wire 34 can be electrically connected to the circuit board 40, electrically coupled to the circuit board 40 or not connected to the circuit board 40 (i.e., in floating connection).

In a modified embodiment, one end of the first end 341 and the second end 342 is in electrical connection and electrical coupling with the circuit board 40, or one end of the first end 341 and the second end 342 is in floating connection.

Through the design of the above electrical connection method, the three-dimensional decoupling structure 30 and the antenna structure 100 can also have higher design freedom, achieve more quantifiable, more accurate and faster design, and have more opportunities to improve manufacturability and reduce the size of the decoupling structure and the antenna structure 100.

Embodiment 14

Figure 17:
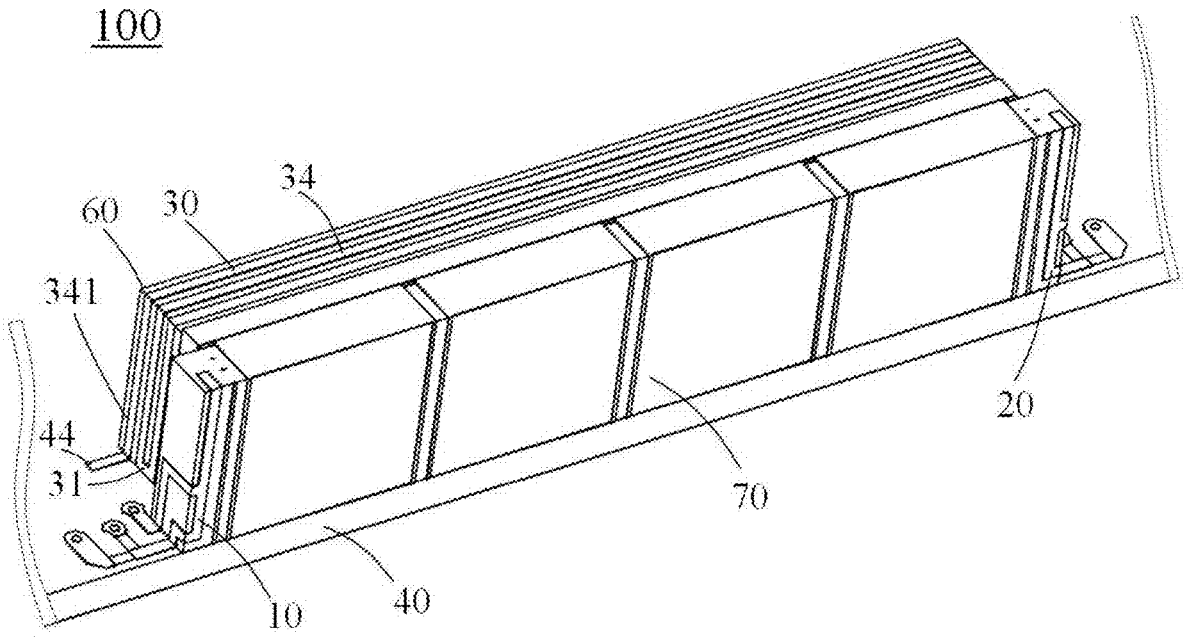
FIG. 17 is a perspective diagram of the antenna structure according to embodiment 14 of the present disclosure.

Refer to FIG. 17, which is a perspective diagram of the antenna structure according to embodiment 14 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 14, there are three conductive wires 34, and the conductive wire 34 comprises a first end 341. The first ends 341 of two adjacent conductive wires 34 among the three conductive wires 34 are electrically connected through a first electrical connection part 31, and the first end 341 of another conductive wire 34 among the three conductive wires 34 is electrically connected to the first terminal 44.

Through the design of the above electrical connection method, the three-dimensional decoupling structure 30 and the antenna structure 100 can also have higher design freedom, achieve more quantifiable, more accurate and faster design, and have more opportunities to improve manufacturability and reduce the size of the decoupling structure and the antenna structure 100.

Embodiment 15

Figure 18:
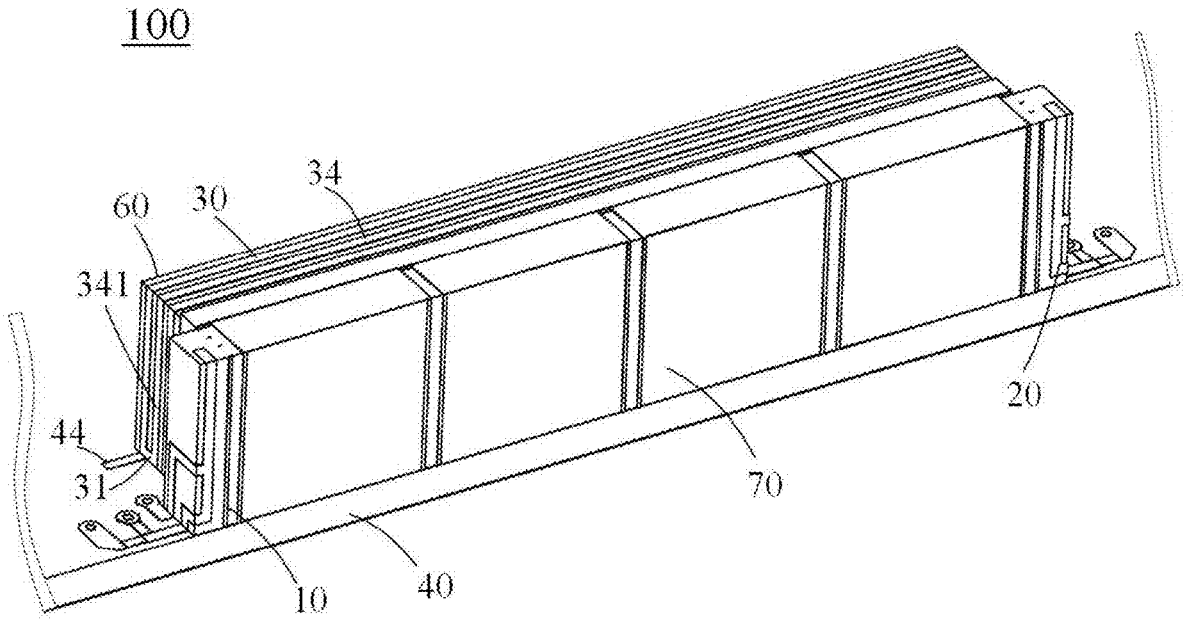
FIG. 18 is a perspective diagram of the antenna structure according to embodiment 15 of the present disclosure.

FIG. 18 is a perspective diagram of the antenna structure according to embodiment 15 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 15, there are three wires 34, and at least one end of the opposite ends of at least one of the wires 34 is in electrical connection, electrical coupling or floating connection with the circuit board 40, respectively. The wire 34 comprises a first end 341, the first ends 341 of two adjacent conductive wires 34 among the three conductive wires 34 are electrically connected by a first electrical connection part 31, and the first electrical connection part 31 is in electrical connection, electrical coupling or floating connection with the circuit board 40. Specifically, in this embodiment, the first electrical connection part 31 is electrically connected with the first terminal 44. The first end 341 of another conductive wire 34 among the three conductive wires 34 is not connected to the circuit board 40.

Through the design of the above electrical connection method, the three-dimensional decoupling structure 30 and the antenna structure 100 can also have higher design freedom, achieve more quantifiable, more accurate and faster design, and have more opportunities to improve manufacturability and reduce the size of the decoupling structure and the antenna structure 100.

Embodiment 16

Figure 19:
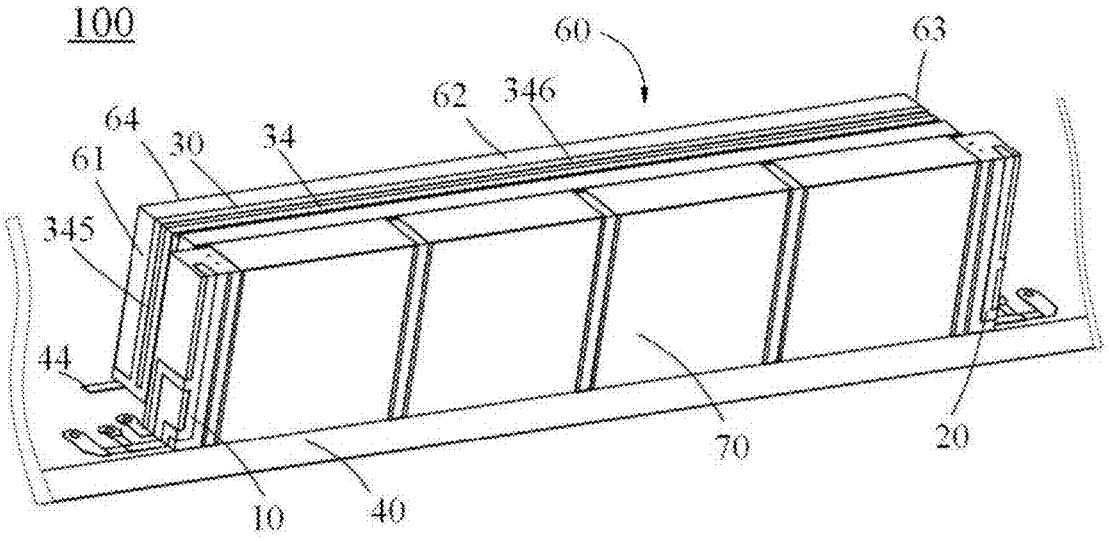
FIG. 19 is a perspective diagram of the antenna structure according to embodiment 16 of the present disclosure.
Figure 20:
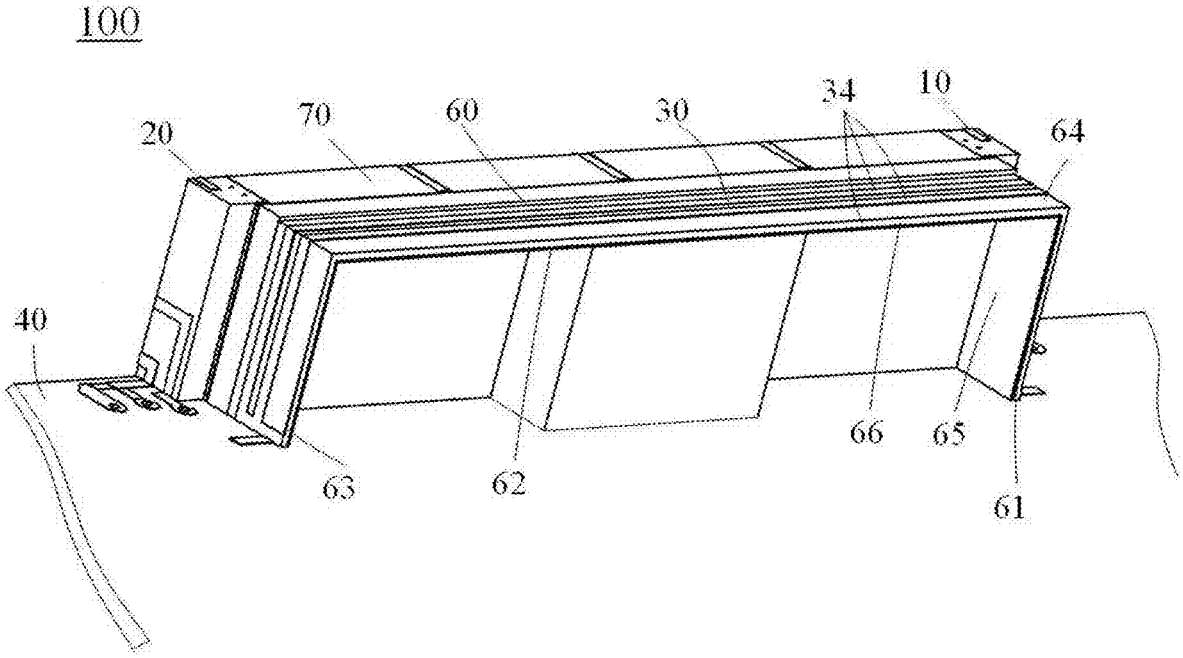
FIG. 20 is a perspective diagram of the antenna structure shown in FIG. 19 from another angle.

Refer to FIG. 19 and FIG. 20. FIG. 19 is a perspective diagram of the antenna structure according to embodiment 16 of the present disclosure, and FIG. 20 is a perspective diagram of the antenna structure shown in FIG. 19 from another angle. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 16, the three-dimensional decoupling structure support 60 further comprises a third side surface 64 respectively connected with the first side surface 61, the top surface 62 and the second side surface 63. There are three conductive wires 34, wherein at least part of two conductive wires 34 are provided on the top surface 62, and at least part of one conductive wire 34 is provided on the end surface 66. The conductive wire 34 is provided on the end surface 66 of the three-dimensional decoupling support 60, so that the space of the three-dimensional decoupling structure support 60 can be effectively utilized, and the volume of the three-dimensional decoupling structure support 60 can be reduced, so that the volume of the antenna structure 100 is reduced and the space utilization rate is improved.

It can be understood that the number of the wires 34 is not limited to three. One, two or more conductive wires can be provided on the top surface 62, and one, two or more conductive wires can be provided on the third side surface 66.

Embodiment 17

Figure 21:
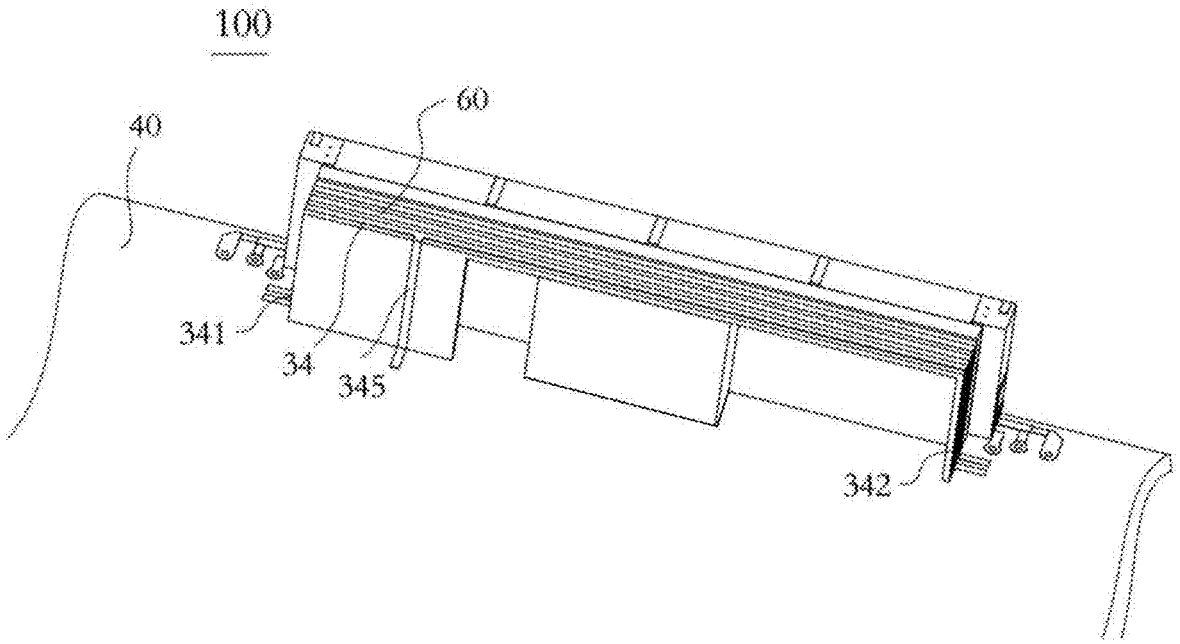
FIG. 21 is a perspective diagram of the antenna structure according to embodiment 17 of the present disclosure.

Refer to FIG. 21, which is a perspective diagram of the antenna structure 100 according to embodiment 17 of the present disclosure. The antenna structure 100 according to this embodiment is a variation scheme of the antenna structure 100 according to embodiment 1. The part in which the scheme of the antenna structure 100 in this embodiment is the same as that in embodiment 1 will not be described in detail, and the differences of the antenna structure 100 in this embodiment will be described emphatically.

In embodiment 17, each of the conductive wires 34 comprises a first end 341, a second end 342 opposite to the first end 342, and a middle part 343 between the first end 341 and the second end 342, but the middle part 343 of at least one conductive wire 34 can be connected with another conductive wire 345, wherein the another conductive wire 345 can be in electrical connection or electrical coupling with the circuit board 40, or can be in floating connection with the circuit board (not electrically connected or electrically coupled with the circuit board 40).

In embodiment 17, the middle part 343 is connected to another conductive wire 345 by at least one conductive wire 34, so that the three-dimensional decoupling structure 60 has higher design freedom, and achieves the effect of multi-frequency and broadband decoupling, which is conducive to the compactness of the overall structure and the miniaturization of the structure size.

It can be understood that in the various embodiments shown in FIGS. 1 to 21, a plurality of (including two or more) antennas are decoupled by utilizing the conductive three-dimensional decoupling structure of adjacent antennas, so that the three-dimensional space of the system can be better utilized, that is, the occupied horizontal area in the system can be reduced, so that the utilization rate of limited space can be improved, and a projected clearance area (i.e., area without conductors) does not need to be provided on the board, so that the integrity of the system motherboard can be better maintained and the decoupling performance can be prevented from being affected by the metal environment or component(s) under the board. In addition, the present disclosure can also provide a conductive three-dimensional decoupling structure consisted of a plurality of wires, and the decoupling frequency corresponding to the three-dimensional decoupling structure can fall within the frequency band of the antenna design target by designing appropriate geometric dimensions (such as length, width, radian, etc.), number, electrical connection situation, material (non-conductor) of the three-dimensional decoupling structure support or carrier, the support or carrier structure and so on, so as to perform broadband or multi-frequency decoupling to reduce the degradation degree of antenna performance and ensure or enhance the wireless experience of users. The conductive three-dimensional decoupling structure consisted of a plurality of conductive wires can be electrically connected by wiring or by electronic components, so as to achieve higher design freedom and more performance control, and further reduce the occupied space of the decoupling structure. The width of the single conductive decoupling structure is preferably wider than $1/10000$ of the wavelength corresponding to the lowest target decoupling frequency, and the spacing between the decoupling structures consisted of a plurality of wires is preferably wider than $1/10000$ of the wavelength corresponding to the lowest target decoupling frequency.

In addition, the three-dimensional decoupling structure of the antenna structure of the various embodiments shown in FIGS. 1 to 21 has various structures. It can be seen that the antenna structure and its three-dimensional decoupling structure disclosed in the embodiments of the present disclosure have more flexible design freedom, achieve more quantifiable, more accurate and faster design of the decoupling structure and the antenna structure, and have more opportunities to improve manufacturability and reduce the size of the decoupling structure and the antenna structure. In addition, the influence on the original antenna target performance can be reduced, and the effective decoupling effect can be achieved, so as to reduce the degradation degree of antenna performance due to coupling, thereby ensuring or improving the wireless communication experience of users.

In addition, the types of the decoupled antennas (i.e., the first antenna 10 and the second antenna 29) are not limited, which can be IFA (an inverted F antenna), PIFA (a planar inverted F antenna), an monopole antenna, a dipole antenna, a patch antenna, a stacked patch antenna, a Yagi-Uda antenna, a slot antenna, a magnetic-electric dipole antenna, a horn antenna, a loop antenna, a grid antenna, an open-cavity antenna and the like. The realization process of the conductive decoupling structure and the antenna can be conductor wiring of LTCC (low-temperature co-fired ceramic) or HTCC (high-temperature co-fired ceramic), LDS (laser direct structure), PDS (printed direct circuits), FPC (flexible printed circuits), or stamping. Similarly, the shape, position and size of the three-dimensional decoupling structure support 60 are not limited.

Figure 22:
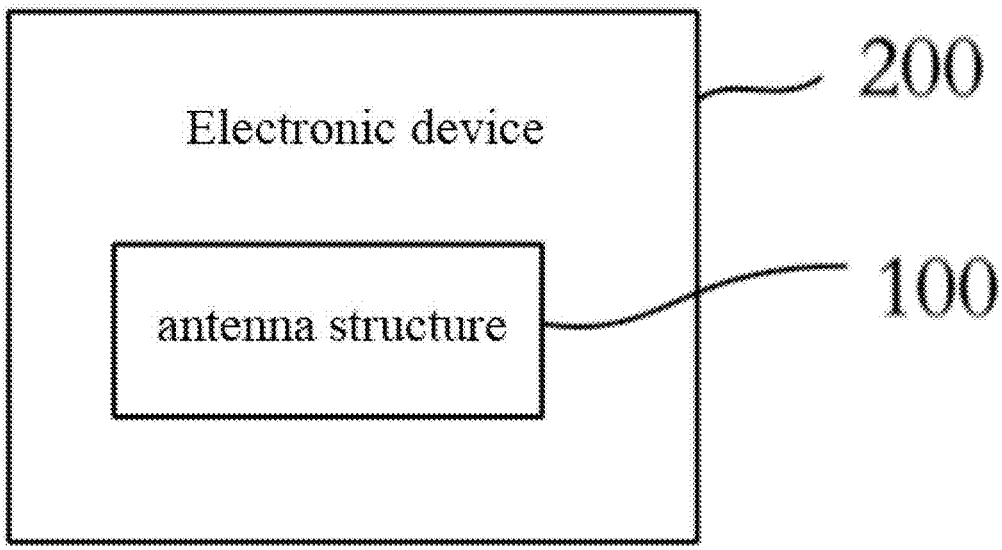
FIG. 22 is a schematic block structure diagram of an electronic device with an antenna structure according to the present disclosure.

Refer to FIG. 22, which is a schematic block structure diagram of an electronic device with an antenna structure according to the present disclosure. An embodiment of the present disclosure discloses an electronic device 200, which comprises the antenna structure 100 described in any of the above embodiments.

It can be understood that the electronic device 200 adopts the antenna structure 100, so it can be understood that the electronic device 200 naturally has the effect characteristics of the antenna structure 100, which is not described here.

The electronic device disclosed in the embodiment of the present disclosure has been described in detail above, and the principle and implementation of the present disclosure have been illustrated by specific examples herein. The explanation of the above embodiment is only used to help understand the electronic device of the present disclosure and its core ideas. At the same time, according to the idea of the present disclosure, there will be some changes in the specific implementation and application scope for those skilled in the art. To sum up, the contents of this specification should not be construed as limiting the present disclosure.

What is claimed is:

1. An antenna structure, comprising:

a circuit board;

a first antenna connected to the circuit board;

a second antenna connected to the circuit board; and a three-dimensional decoupling structure, wherein the three-dimensional decoupling structure comprises a conductor, the conductor comprises a first conductive wire, the first conductive wire comprises a first sub conductive wire having a first end connected to the circuit board and a second end away from the first end, a second sub conductive wire having a third end connected to the circuit board and a fourth end away from the third end, and a third sub conductive wire connected to the second end and the fourth end, the first sub conductive wire together with the second sub conductive wire and the third sub conductive wire form a U shape, and at least part of the three-dimensional decoupling structure is located in a space between the first antenna and the second antenna.

2. The antenna structure according to claim 1, wherein the three-dimensional decoupling structure is independent of both the first antenna and the second antenna in electrical connection.

3. The antenna structure according to claim 1, wherein the first sub conductive wire is located on a first plane, the second conductive wire is located on a second plane, and the third sub conductive wire is located on a third plane intersecting with the first plane and the second plane, the third sub conductive wire is located in a space between the first antenna and the second antenna and is independent of both the first antenna and the second antenna in electrical connection.

4. The antenna structure according to claim 3, wherein the conductor further comprises a second conductive wire and a third conductive wire, and all the conductive wires are provided in parallel at intervals.

5. The antenna structure according to claim 1, wherein the first antenna and the second antenna both comprise an antenna main body, a grounding part connected to the antenna main body, an antenna feed source part connected to the antenna main body and a matching network part or an adjustable component part connected to the antenna main body; at least parts of the grounding part, the antenna feed source part and the matching network part or the adjustable component part are provided on the circuit board and are in electrical connection with the circuit board.

6. The antenna structure according to claim 4, wherein each of the second conductive wire and the third conductive wire is in a U-shape, and comprises a fifth end and a sixth end connected to the circuit board, the first end of the first conductive wire is electrically connected to the fifth ends of the second conductive wire and the third conductive wire through a first electrical connection part, and the first electrical connection part is in electrical connection, electrical coupling or floating connection with the circuit board.

7. The antenna structure according to claim 6, wherein the third end of the first conductive wire is electrically connected to the sixth ends of the second conductive wire and the third conductive wire through a second electrical connection part, and the second electrical connection part is in electrical connection, electrical coupling or floating connection with the circuit board; or the third end of the first conductive wire, the sixth ends of the second conductive wire and the third conductive wire are in electrical connection, electrical coupling or floating connection with the circuit board.

8. The antenna structure according to claim 4, wherein any two adjacent conductive wires are electrically connected through a third electrical connection part.

9. The antenna structure according to claim 4, wherein at least one of the first conductive wire, the second conductive wire and the third conductive wire comprises a first conductive wire part and a second conductive wire part, and the first conductive wire part and the second conductive wire part are in electrical connection through a third electrical connection part.

10. The antenna structure according to claim 1, wherein the antenna structure further comprises a planar decoupling structure, and the planar decoupling structure and the three-dimensional decoupling structure are in electrical connection through a third electrical connection part.

11. The antenna structure according to claim 4, wherein each of the second conductive wire and the third conductive wire comprises a fifth end and a sixth end opposite to the fifth end, at least one of the first end and the fifth ends of the second conductive wire and the third conductive wire are electrically connected through a first electrical connection part, the first electrical connection part is also in electrical connection, electrical coupling or floating connection with the circuit board; and/or at least two of the third end and the sixth ends of the second conductive wire and the third conductive wire are electrically connected through a second electrical connection part, and the second electrical connection part is also in electrical connection, electrical coupling or floating connection with the circuit board.

12. The antenna structure according to claim 4, wherein the antenna structure further comprises a three-dimensional decoupling structure support provided on the circuit board, the conductive wire is provided on the three-dimensional decoupling structure support; the antenna structure further comprises a first structure provided on the circuit board and located on one side of the three-dimensional decoupling structure support, and at least parts of the first antenna and the second antenna are provided on the first structure.

13. An electronic device, comprising the antenna structure according to claim 1.

14. The antenna structure according to claim 12, wherein the three-dimensional decoupling structure support comprises a first side board, a top board connected to the first side board, a second side board connected to the top board and opposite to the first side board, and a third side board connected to the first side board, the top board and the second side board, the first sub conductive wire is arranged on the first side board, the second sub conductive wire is arranged on the top board, and the third sub conductive wire is arranged on the second side board.

15. The antenna structure according to claim 2, wherein the first structure comprises a first surface and a second surface intersecting with the first surface, at least one of the first antenna and the second antenna comprises a first part arranged on the first surface and a second part connected with the first part and arranged on the second surface.

16. The antenna structure according to claim 4, wherein the circuit board comprises a main surface where the three-dimensional decoupling structure is connected to, a back surface parallel to the main surface, and a side surface connecting between the main surface and the back surface, a projection of the first conductive wire on the circuit board is on the main surface and a cross section of the first conductive wire along a direction perpendicular to the main surface is a U shape.

17. An antenna structure, comprising:

a support, comprising at least two board interconnected with each other to form a three-dimensional structure;

a first antenna;

a second antenna, wherein the first antenna and the second antenna are arranged at interval on at least one side of the support; and a three-dimensional decoupling structure arranged on the at least two boards of the support, wherein at least part of the three-dimensional decoupling structure is located in a space between the first antenna and the second antenna.

18. The antenna structure according to claim 17, wherein the at least two boards comprises a first board, a second board connected to the first board and a third board connected to the second board, the first board and the third board are arranged at the same side of the second board, the three-dimensional decoupling structure extends from the first board to the third board.

* * * * *